US006607813B2

(12) United States Patent
Washburn et al.

(10) Patent No.: US 6,607,813 B2
(45) Date of Patent: Aug. 19, 2003

(54) SIMULATED SECURITY THREAD BY CELLULOSE TRANSPARENTIZATION

(75) Inventors: David E. Washburn, Kettering, OH (US); Harry A. Seifert, Kettering, OH (US); Watson L. Gullett, Spring Valley, OH (US); Rajendra Mehta, Dayton, OH (US)

(73) Assignee: The Standard Register Company, Dayton, OH (US)

( * ) Notice: Subject to any disclaimer, the term of this patent is extended or adjusted under 35 U.S.C. 154(b) by 37 days.

(21) Appl. No.: 09/935,933

(22) Filed: Aug. 23, 2001

(65) Prior Publication Data

US 2003/0082348 A1 May 1, 2003

(51) Int. Cl.[7] ..... D21H 19/68

(52) U.S. Cl. ..... 428/211; 8/119; 283/95; 283/113; 428/916

(58) Field of Search ..... 8/119; 283/95, 283/113; 428/211, 916

(56) References Cited

U.S. PATENT DOCUMENTS

| | | | |
|---|---|---|---|
| 2,021,141 | A | 11/1935 | Boyer |
| 2,370,186 | A | 2/1945 | Oldofredi |
| 2,760,863 | A | 8/1956 | Plambeck, Jr. |
| 3,043,805 | A | 7/1962 | Burg |
| 3,261,686 | A | 7/1966 | Celeste et al. |
| 3,380,831 | A | 4/1968 | Cohen et al. |
| 3,469,982 | A | 9/1969 | Celeste |
| 3,661,576 | A | 5/1972 | Crary |
| 3,813,261 | A | 5/1974 | Muller |
| 3,985,927 | A | 10/1976 | Norris et al. |
| 4,128,437 | A | 12/1978 | Ura et al. |
| 4,137,046 | A | 1/1979 | Koike et al. |
| 4,237,185 | A | 12/1980 | Lombardi et al. |
| 4,271,227 | A | 6/1981 | Muller et al. |
| 4,416,950 | A | 11/1983 | Muller et al. |
| 4,513,056 | A | 4/1985 | Vernois et al. |
| 4,526,803 | A | 7/1985 | White |
| 4,569,888 | A | 2/1986 | Muller et al. |
| 4,760,239 | A | 7/1988 | Makin |
| 4,824,486 | A | 4/1989 | Lafler |
| 4,919,044 | A | 4/1990 | Lafler |
| 4,956,225 | A | 9/1990 | Malhotra |
| 4,997,697 | A | 3/1991 | Malhotra |
| 5,055,354 | A | 10/1991 | Simcoke |
| 5,207,871 | A | 5/1993 | Murphy et al. |
| 5,275,870 | A | 1/1994 | Halope et al. |
| 5,416,126 | A | 5/1995 | Murphy et al. |
| 5,418,205 | A | 5/1995 | Mehta et al. |
| 5,573,639 | A | 11/1996 | Schmitz et al. |
| 5,849,398 | A | 12/1998 | Petrosky |
| 5,928,471 | A | 7/1999 | Howland et al. |
| 5,989,389 | A | 11/1999 | Sundberg |
| 5,993,603 | A | 11/1999 | Johnston |
| 6,103,355 | A | 8/2000 | Mehta |
| 6,143,120 | A | 11/2000 | Mehta et al. |

*Primary Examiner*—Bruce H. Hess
(74) *Attorney, Agent, or Firm*—Killworth, Gottman, Hagan & Schaeff, LLP

(57) ABSTRACT

A security document is provided comprising a finished cellulosic substrate having at least one transparentized portion formed therein. The transparentized portion comprises a transparentizing composition that is applied so as to define an area of increased transparency in the substrate. The area of increased transparency includes at least one thin line and resembles a simulated security thread. The transparentizing composition can be applied to form thin lines in a variety of configurations on one or both sides of the substrate.

54 Claims, 5 Drawing Sheets

SIMULATED SECURITY THREAD BY CELLULOSE TRANSPARENTIZATION

CROSS-REFERENCE TO RELATED APPLICATIONS

This application is related to commonly assigned U.S. patent application Ser. No. 09/300,118 MULTI-FUNCTIONAL TRANSPARENT SECURE MARKS, filed Apr. 27, 1999, now U.S. Pat. No. 6,358,894, by Mehta, et al., the disclosure of which is incorporated herein by reference.

BACKGROUND OF THE INVENTION

The present invention relates generally to a security document and, more particularly, to a security document having simulated security threads.

Many documents of value, such as bank notes, currency, checks, stock certificates, and bonds, are provided with security features for preventing illicit copying and forgery. One such security feature is the use of security paper that is not widely available and difficult to reproduce. One type of security paper includes threads or filaments of various materials in the paper.

Security threads or filaments included in prior security papers have typically been made of a metallic, colored, transparent, optical, or magnetic material. These materials can provide effective anti-copying functions, as well as permitting documents to be checked for authenticity by machine or visual inspection. The filaments can be embedded into the security paper during the manufacture thereof, or added to less expensive paper after the paper has been manufactured.

As is known, various compositions can be applied to a cellulosic substance to make it relatively transparent. For example, U.S. Pat. Nos. 5,418,205, 6,103,355, and 6,143,120 describe the application of solventless transparentizing compositions of the type used in the present invention to a cellulosic substrate to transparentize a portion of the substrate. In each of these references, the transparentized portion defines an area in the cellulosic through which text can be viewed. A transparentized portion of a substrate permits an addressee's name and address to be read through the substrate which is a part of an envelope or mailer.

It is also known that security paper can be produced by transparentizing selected areas of the paper. For example, U.S. Pat. No. 5,989,389 provides a method of producing visible, continuous streaks and/or delimited fields in paper. This paper is particularly useful for bank notes. However, the method of the '389 patent does not employ a transparentizing composition. Instead, this method produces transparent streaks in the paper by depositing in the streak area a special paper stock that contains fibers which differ from the surrounding cellulosic material.

Further known are security documents that can be manufactured by applying a transparentizing resin to at least a portion of a substantially unfinished porous absorbent sheet to define a transparent region, pattern, or series of streaks. U.S. Pat. No. 5,928,471. The transparentizing resin used in the method of the '471 patent differs from the transparentizing composition of the present invention. Further, the transparentizing resin of the '471 patent is applied to a series of discrete areas in the substantially unfinished cellulosic sheet which are at least partially of a lower grammage than the surrounding area.

U.S. patent application Ser. No. 09/300,118 teaches the application of the transparentizing composition of the present invention to a cellulosic substrate in a predetermined pattern, so as to create a relatively transparent graphical image, such as a watermark, for security documents. However, neither the '471 patent nor the '118 application teaches a security document that is formed by applying a transparentizing material to a finished cellulosic substrate in thin lines to create simulated security thread in the document.

It would be desirable to manufacture an alternative type of security document embodying simulated security thread as a security feature. It would also be desirable to manufacture a security document with simulated security thread by application of a transparentizing composition in thin lines, rather than embedding an actual security thread or filament in the substrate. Accordingly, there is a need in the present art to develop an alternative security document with enhanced features that are effective in preventing forgery and illegal copying thereof.

BRIEF SUMMARY OF THE INVENTION

The present invention meets that need by providing a security document comprising a finished cellulosic substrate. In accordance with one embodiment of the present invention, the security document comprises a finished cellulosic substrate having at least one transparentized portion formed therein. The substrate defines first and second major surfaces. The transparentized portion comprises a transparentizing composition applied to at least one of the first and second major surfaces of the substrate so as to define an area of increased transparency. The area of increased transparency includes at least one thin line and resembles a simulated security thread. Alternatively, the transparentizing composition can be applied to at least one of the first and second major surfaces of the substrate to define a plurality of thin lines.

The substrate can be comprised of a material selected from the group consisting of wood pulp fibers, vegetable fibers, plant fibers, plastics, synthetics, and polymeric films, and combinations thereof. The substrate can comprise either a web of material or individual cut sheets, and can further comprise printed indicia on at least one of the first and second major surfaces.

In one embodiment of the present invention, the substrate defines an area of reduced thickness. This area of reduced thickness defines the transparentized portion and can lie on the first major surface, or both the first major surface and the second major surface. The transparentized portion of the present embodiment defines the simulated security thread. It has a higher density than and does not exceed the thickness of the reminder of the substrate.

In accordance with yet another embodiment of the present invention, the area of reduced thickness may define a groove in the substrate. This groove can be slightly rounded along its top and bottom portions. In accordance with yet another embodiment of the present invention, the groove can have relatively vertical side walls.

The cellulosic substrate may define a textured portion and the at least one line or plurality of lines may be further defined by the textured portion. The textured portion and the transparentized portion may lie in common areas of the substrate. The textured portion and the transparentized portion may define substantially identical boundaries and may be positioned in substantial alignment on the substrate. The textured portion may define a variable thickness profile across which is applied the transparentizing composition such that the area of increased transparency defines a varying transparency.

The transparentizing composition of the present invention can comprise a radiation-curable composition, or a composition selected so as to cure upon contact with the substrate. In accordance with yet another embodiment of the present invention, the transparentizing composition can further comprise a security agent. The security agent can comprise a photochromic agent, a thermochromic agent, a fluorescent agent, a coloring agent, a fragrance, a UV ink, an optically variable ink, or a combination thereof.

In accordance with yet another embodiment of the present invention, the transparentized portion further comprises a printed portion. The printed portion comprises printed matter, which can comprise a line of text written in white ink, thermochromic ink, photochromic ink, or combinations thereof. In the present embodiment, the printed matter can be either completely or partially covered by the transparentizing composition. The printed matter can lie in the area of reduced thickness of the substrate, and may comprise an amount field of a negotiable document or some other secure data field.

In yet another embodiment of the present invention, the at least one thin line can comprise a first simulated security thread and a second simulated security thread. The first and second simulated security threads can be formed on the same major surface of the substrate and may also overlap. The first and second simulated security threads of the present invention can be a first color and a second color. The first color can be different than the second color.

The simulated security thread of the present invention can be linear or curvilinear. The curvilinear simulated security thread can be asymmetrical. The simulated security thread can be of varying width, as well as discontinuous, or can comprise a plurality of individual discrete simulated security threads. The simulated security thread can extend in a direction which is parallel to a machine direction of the substrate. Alternatively, the simulated security thread can extend in a direction which is parallel to a cross-web direction of the substrate, or interspersed along a machine direction and a cross-web direction of the substrate, or extend in a direction which is diagonal between a machine direction and a cross-web direction of the substrate.

In accordance with yet another embodiment of the present invention, a security document is provided, comprising a finished cellulosic substrate having at least one transparentized portion formed therein. The substrate defines first and second major surfaces. The transparentizing portion comprises a transparentizing composition applied to at least one of the first and second major surfaces to define an area of increased transparency in the substrate, resembling a simulated security thread. The transparentizing composition comprises at least one compound selected from compounds of the formula:

(I)

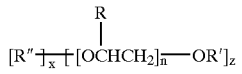

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different; or (II)

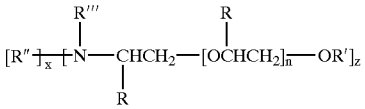

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R'" is H or a group of the formula:

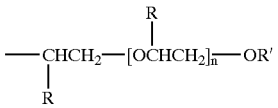

wherein R, R', and n are as defined as above, wherein if any of R, R', R" or R'" are greater than one, their identities and the number of each may be the same or different.

In accordance with yet another embodiment of the present invention, a security document is provided, comprising a finished cellulosic substrate having at least one transparentized portion formed therein. The substrate defines first and second major surfaces. The transparentizing portion comprises a transparentizing composition applied to at least one of the first and second major surfaces to define an area of increased transparency in the substrate, resembling a simulated security thread. The transparentizing composition comprises:

i) a cationic catalyzable constituent selected from 1) a vinyl ether, 2) a polyepoxide, 3) a mixture of vinyl ethers, 4) a mixture of polyepoxides, or 5) a mixture of at least one of a vinyl ether and at least one of a polyepoxide;

ii) a free radical catalyzable constituent selected from at least one compound of the formula:

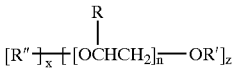

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different; and iii) a catalyst constituent selected from 1) a free radical catalyst, 2) a mixture of free radical catalysts, 3) a living cationic catalyst, 4) a mixture of living cationic catalysts, or 5) mixtures of at least one of a free radical catalyst and at least one of a living cationic catalyst.

In accordance with yet another embodiment of the present invention, a security document is provided, comprising a finished cellulosic substrate having at least one transparentized portion formed therein. The substrate defines first and second major surfaces. The transparentizing portion comprises a transparentizing composition applied to at least one of the first and second major surfaces to define an area of increased transparency in the substrate, resembling a simulated security thread. The transparentizing composition comprises at least one monomer, selected from the group consisting of acrylic esters of polyhydric alcohols, methacrylic esters of polyhydric alcohols, and vinyl ethers.

In accordance with yet another embodiment of the present invention, a security document is provided, comprising a finished cellulosic substrate having at least one transparentized portion formed therein. The substrate defines first and second major surfaces. The transparentizing portion comprises a transparentizing composition applied to at least one of the first and second major surfaces to define an area of increased transparency in the substrate, resembling a simulated security thread. The transparentizing composition comprises a polymer consisting of aliphatic monomers selected from the group consisting of acrylic esters of polyhydric alcohols, methacrylic esters of polyhydric alcohols, and vinyl ethers.

Accordingly, it is a feature of the present invention to enhance document security by applying at least one thin line of a transparentizing composition to a finished cellulosic substrate to simulate a security thread. This feature will provide enhanced document security without having to embed an actual thread or filament in the substrate. Therefore, the simulated security thread of the present invention can provide significant cost savings as compared to conventional security paper with embedded threads or filaments. Further, it is a feature of the present invention to realize improved economics by (i) enabling the production of a security document that includes lines which resemble simulated security threads on bond paper stock as opposed to premium paper stock and (ii) enabling economical customization of simulated security threads.

Further, it is a feature of the present invention to provide a security document including lines on both major surfaces of the cellulosic substrate. Also, it is a feature of the present invention to provide a security document with lines applied in random, opposite directions so that they are non-repeating relative to the printed matter. Moreover, it is a feature of the present invention to provide a security document prepared using printing plates to apply lines that are both horizontal and/or diagonal, relative to the paper web.

These, and other features and advantages of the present invention, will be apparent in light of the following detailed description, the accompanying drawings, and the appended claims that are embodied herein.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
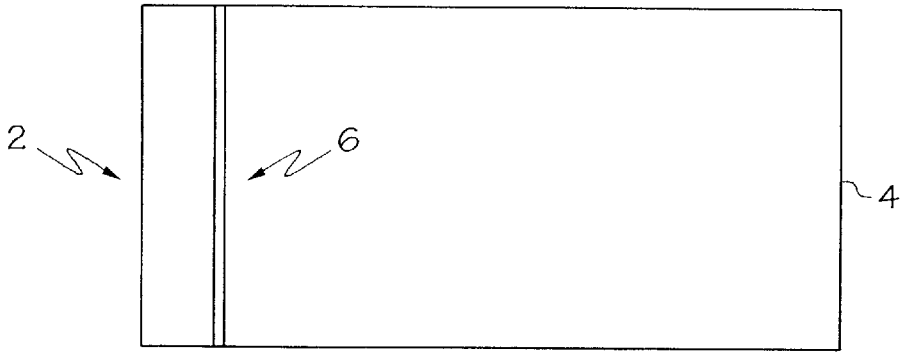
FIG. 1 is an enlarged, schematic illustration of a cellulosic substrate including a simulated security thread according to the present invention.

FIG. 1 illustrates a security document 2 constructed according to a first embodiment of the present invention. It should be appreciated that FIG. 1, as well as FIGS. 2–16, is not drawn to scale, but is drawn to illustrate the present invention with clarity. As shown in FIG. 1, the security document 2 comprises a finished cellulosic substrate 4 including a simulated security thread 6. While the substrate 4 of the present invention typically is made of wood pulp fibers, the substrate 4 may also be comprised of a variety of suitable materials, as is known in the art, such as for example vegetable fibers, plant fibers, additives, fillers, plastics, synthetics, and polymeric films, and combinations thereof. Furthermore, the substrate 4 may be in the form of a web of material or in the form of an individual cut sheet.

Figure 2:
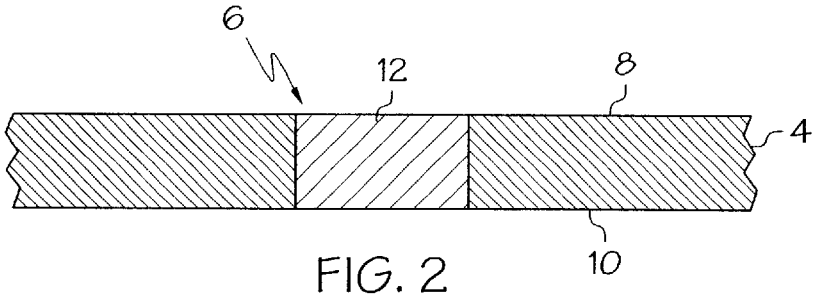
FIG. 2 is an enlarged, schematic illustration, in cross section, of a cellulosic substrate including a portion of a simulated security thread according to the present invention.

As illustrated in FIG. 2, the substrate 4 defines first and second major surfaces 8, 10 and at least one transparentized portion formed therein. The transparentized portion comprises a transparentizing composition 12 applied to at least one of the first and second major surfaces 8, 10 of the finished substrate 4 to produce at least one thin line having a relative transparency selected so as to define an area of increased transparency in the substrate 4. This area of increased transparency resembles a simulated security thread 6. For the purposes of describing the present invention, it is noted that a simulated security thread comprises an area of increased transparency, defining a thin line or plurality of thin lines that can exhibit a variety of shapes and orientations on the substrate. It should be appreciated that traditional security threads and filaments, which are comprised of a variety of formed materials that are either applied to or embedded into a paper substrate, do not fall within the definition of a simulated security thread. It should also be appreciated that a basic substantially rectangular transparent area, i.e., a transparent window, likewise does not fall within the definition of a simulated security thread. Rather, according to the description herein of the present invention, the transparentized portion is configured to resemble a simulated security thread.

In the illustrated embodiment, the transparentizing composition 12 is applied to at least one of the first and second major surfaces 8, 10 of the finished substrate 4. By finished, we mean a substrate that has already been manufactured. For descriptive purposes, the finished substrate 4 is transformed into the security document 2 once the transparentizing composition 12 is applied to the finished substrate 4.

In the prior art it is typical for security features to be added to the substrate during the substrate manufacturing process, significantly increasing the cost of manufacturing the security document. In contrast, in the present invention, a finished cellulosic substrate 4 is employed. Because the transparentizing composition 12 may be applied to a finished substrate 4, as opposed to a substrate requiring additional manufacturing steps after application of a transparentizing material, virtually any manufactured paper may be used with the present invention. Therefore, the cost of manufacturing the security document is significantly reduced, as the finished substrate 4 does not have to be specially designed or manufactured for use with the present invention. By using, for example, commodity grade paper, the present invention avoids the expense associated with placing large minimum orders for special security paper as is often required by paper manufactures. The present invention permits the production of security documents on a more limited scale, and at a lower cost.

As is also illustrated in FIG. 2, the transparentizing composition 12 is absorbed into the substrate 4. The transparentizing composition 12 can be applied to at least one of the major surfaces 8, 10 by employing flexographic, gravure, letterpress, or lithographic printing equipment, with flexographic and gravure being preferred due to their ability to accommodate the very low viscosity of the transparentizing composition 12. A nozzle, such as a slot coater, which is equipped with a very small orifice, may also be employed in applying the transparentizing composition 12, to define precisely the bounds of the simulated security thread 6. The transparentizing composition 12 can be applied simultaneously in corresponding areas on both of the major surfaces 8, 10 to provide faster penetration of the transparentizing composition 12 into the substrate 4. This simultaneous application can be performed with perfecting cylinders, such as lithographic and flexographic printing equipment. The width of the simulated security thread 6 can be between about 0.015 and about 0.0625 inches.

Figure 3:
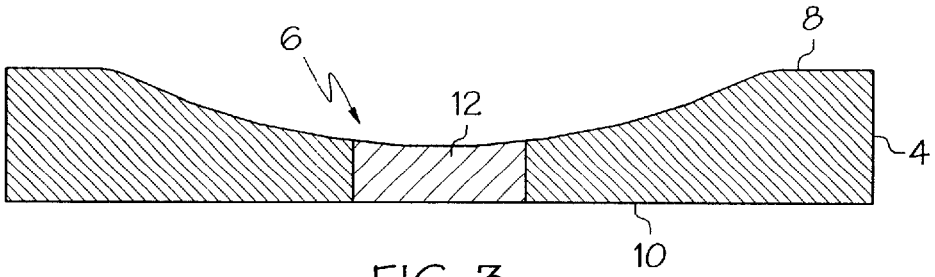
FIG. 3 is an enlarged, schematic illustration, in cross section, of a cellulosic substrate including a reduced thickness portion and a portion of a simulated security thread according to the present invention.

In an alternative embodiment of the present invention, illustrated in FIG. 3, the thickness of the substrate 4 is reduced in the area in which the transparentizing composition 12 is applied. The transparentized portions that define the simulated security thread 6 will therefore be thinner and have a higher density than the remaining areas of the substrate 4. In this manner, it is possible to ensure that the thickness of the substrate 4 in the area in which the transparentizing composition 12 is absorbed does not exceed the thickness of the remainder of the substrate 4. Otherwise, the increased thickness of the area in which the transparentizing composition 12 is absorbed may create problems in stacking, sorting, or processing sheets that include the simulated security thread 6 of the present invention.

Although FIG. 3 shows the reduction in thickness as having been performed on the first major surface 8 of the substrate 4, this should not be interpreted as a limitation of this embodiment of the present invention. A reduction in thickness may also be performed on the second major surface 10, or with respect to both major surfaces 8, 10.

Additionally, although FIG. 3 shows a reduction of the thickness of the substrate 4 wherein there is gradual sloping, this is not the only embodiment contemplated. The thickness of the substrate 4 may also be reduced such that there is more abrupt sloping.

Another method to ensure uniform substrate thickness includes compressing the substrate, such as calendaring. Certain predetermined areas of the substrate 4 can be calendared to a predetermined thickness. These predetermined areas of the substrate 4 are those to which the transparentizing composition 12 will be applied, defining the simulated security thread 6. Preferably, the thickness of the predetermined areas of the substrate 4 following compression ranges from about 0.0005 to about 0.002 inches (i.e., about $1.27\times10^{-3}$ to about $5.08\times10^{-3}$ cm).

The preferred technique for compressing the substrate 4 is by calendaring the substrate 4 using calendaring equipment. Calendaring may be accomplished by a pair of rotating cylinders, one of which has raised areas on its surface corresponding to those areas which are to be compressed. Calendaring can be performed to the first major surface 8, the second major surface 10, or both major surfaces 8, 10 of the substrate 4. Alternatively, predetermined areas of the substrate 4 can be made even thinner by mechanical grinding thereof. Preferably, the predetermined areas have a thickness ranging from about 0.0005 to about 0.002 inches (i.e., about $1.27\times10^{-3}$ to about $5.08\times10^{-3}$ cm) following the grinding operation.

Figure 4A:
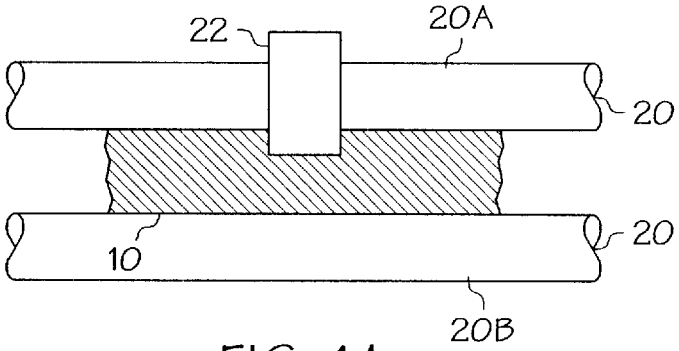
FIG. 4A is an enlarged, schematic illustration, in cross section, showing a process for manufacturing a security document, which employs a raised portion of a roller, constructed according to the present invention.
Figure 4B:
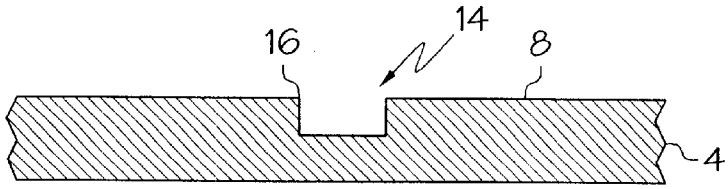
FIGS. 4B and 5B are enlarged, schematic illustrations, in cross section, of cellulosic substrates including a groove, constructed according to the present invention.

As illustrated in FIGS. 4A and 4B, a groove 14 may be formed in a portion 16 of the substrate 4 by compressing the first major surface 8 with rollers 20A, 20B. The arrangement of the rollers 20A, 20B is commonly known as a two-roll calendar, with the rollers 20A, 20B commonly known as calendaring rollers. The second major surface 10 of the substrate 4 is supported by the bottom roller 20B while the groove 14 is formed by the top roller 20A. The top roller 20A includes a raised portion 22 which compresses the substrate 4, and thus, forms the groove 14.

In this illustrative embodiment, the substrate 4, comprised of paper material, may be compressed up to approximately 60% of its nominal thickness under the application of approximately 400 lbs. per linear inch (PLI) of pressure. As is illustrated in FIG. 4B, the compressed groove 14 is slightly rounded along the bottom and top portions of the groove 14. It will be appreciated by those skilled in the art that the degree of rounding of the bottom and top portions of the compressed groove 14 is dependent, in part, on the pressure applied by the rollers 20 and the compression of the substrate 4. It will be further appreciated by those skilled in the art that the transparentizing composition 12 can be applied within the groove 14 as the compressed groove 14 is formed. As is shown in this illustrative embodiment, the groove 14 is formed along a substantially straight or linear line within the substrate 4.

Figure 5A:
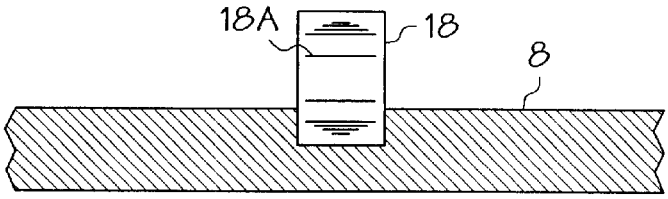
FIG. 5A is an enlarged, schematic illustration, in cross section, showing a process for manufacturing a security document, which employs a cylinder, constructed according to the present invention.
Figure 5B:
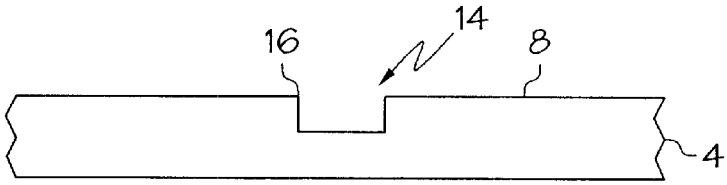

In an alternative embodiment, the groove 14 can be formed in the portion 16 of the substrate 4 by abrading the first major surface 8 with a rotating cylinder 18, as is illustrated in FIGS. 5A and 5B. The cylinder 18 includes a rough surface 18A. The rotating cylinder 18 contacts the first major surface 8 of the substrate 4 and the groove 14 is formed as the rough surface 18A rubs away a portion of the first major surface 8 of the substrate 4. As is illustrated in FIG. 5B, the abraded groove 14 has relatively vertical side walls. It will be appreciated by those skilled in the art that the depth of the groove 14 is dependent, in part, on the pressure exerted by the cylinder 18 on the substrate 4, as well as the thickness of the substrate 4.

Figure 6:
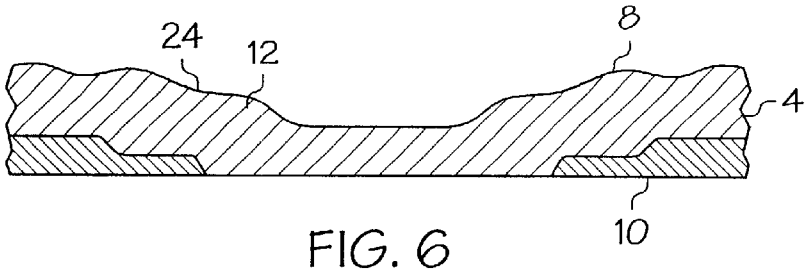
FIG. 6 is an enlarged, schematic illustration, in cross section, of a variable thickness cellulosic substrate including a portion of a simulated security thread according to the present invention.

Referring now to FIG. 6, a further embodiment of the present invention is illustrated. In this illustrated embodiment, the substrate 4 defines a textured portion 24. The at least one thin line that is defined by the transparentizing composition 12 is further defined by the textured portion 24. Preferably, the textured portion 24 and the transparentized portion defining the simulated security thread 6 define substantially identical boundaries and are positioned in substantial alignment on the substrate 4. As is further illustrated in FIG. 6, the textured portion 24 defines a variable thickness profile across which the transparentizing composition 12 is applied. In this manner, the area of increased transparency defines a varying transparency profile across the substrate 4.

Preferably, the transparentizing composition 12 comprises a radiation-curable composition, but may also comprise a composition that cures upon contact with a cellulosic substrate, or by other means. Some means commonly known include thermal cure and a two-component reactive system, which cross-link on contact. One available method to utilize a two-component system is to apply one component to each of the opposite major surfaces 8, 10 with a perfecting press.

Figure 7:
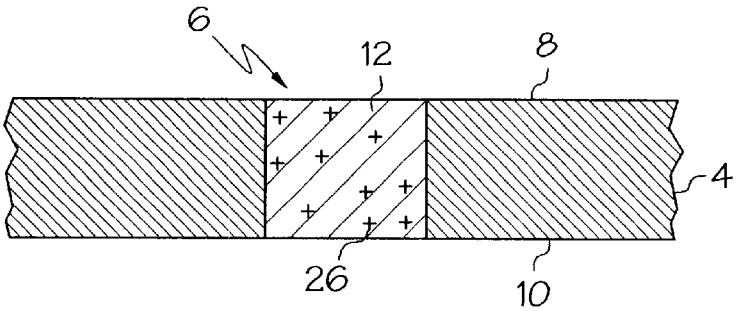
FIG. 7 is an enlarged, schematic illustration, in cross section, of a cellulosic substrate including a portion of an enhanced simulated security thread according to the present invention.

To further enhance the security features of the security document 2 of the present invention, another alternative embodiment is illustrated in FIG. 7. Here, the transparentizing composition 12 further comprises a security agent 26. For the purposes of describing and defining the present invention, it is noted that a security agent comprises any additive that enhances the security of the simulated security thread 6 of the present invention. For example, the transparentizing composition 12 may comprise a security agent 24 in the form of a photochromic agent, a thermochromic agent, a fluorescent agent, a coloring agent, a fragrance, a UV ink, an optically variable ink, or a combination thereof.

In the case of the fluorescent agent and the UV ink, these materials are incorporated into the transparentizing composition 12 to further enhance the visibility of the simulated security thread 6 upon exposure to UV light. Fluorescent materials provide added security as incident light having a first wavelength is absorbed by the fluorescent material and the light of a different wavelength is radiated by the fluorescent material. For example, the fluorescent material may be sensitive to light in the ultraviolet region, such that as ultraviolet light is projected onto the security document 2, the simulated security thread 6 is illuminated, and a portion of the ultraviolet is absorbed. The illuminated simulated security thread 6 then radiates light in the visual region of the spectrum. Preferably, the fluorescent material is soluble in the transparentizing composition 12. The resulting dual-function simulated security thread provides enhanced confidence in the authenticity of a secure document that includes such a dual-function simulated security thread. Even greater confidence in authenticity is provided if the fluorescent agent is one that has been chosen to function in a system designed for the detection of the spectral emissions of a predetermined fluorescent agent.

Similarly, an enhanced simulated security thread is provided where a photochromic material is combined with the transparentizing composition 12. The photochromic material may be soluble in the transparentizing composition 12 or it may be suspended and dispersed as insoluble pigment particles or as micro capsules containing a solvent solution. According to this aspect of the present invention, authenticity of a secure document bearing the simulated security thread 6 is indicated if the security thread changes color when exposed to light of the proper wavelength and intensity.

A multi-functional simulated security thread 6 may also be provided by including a thermochromic agent with the transparentizing composition 12. In this representative embodiment, the simulated security thread 6 is not only visible by transmitted visible light, but also changes color when heated or cooled to the proper activating temperature. Temperature variations may be introduced with an external source or via frictional rubbing.

Still another multi-functional simulated security thread 6 is provided by incorporating an optically variable ink (OVI) into the transparentizing composition 12. In this embodiment, OVI within the transparentizing composition 12 produces a simulated security thread 6 which can possess a pearlescent appearance, and can emulate holographic characteristics, when viewed at different angles.

In accordance with yet another aspect of the present invention, the security of a document including the simulated security thread according to the present invention may be enhanced by embedding, encasing, partially covering, or completely covering specific printed matter with the transparentizing composition 12. In this embodiment, the transparentized portion comprises a printed portion comprising printed matter. The printed matter may comprise specific security printing, e.g., a security pattern, a logo, or a line of text. Text printed in white ink can be covered with the transparentizing composition 12 in the form of the simulated security thread 6 of the present invention, producing a visible message which is resistant to copying or scanning. Moreover, it is also possible to apply the thread over thermochromic and/or photochromic inks, making them less exposed to abuse.

Further, the printed matter may comprise an amount field of a negotiable document or another type of secure data field. The resulting secure document is very difficult to alter or counterfeit. It may be necessary to calender the area in which the printed matter is to be presented to ensure that the thickness of the substrate in this area does not exceed the thickness of the remainder of the substrate 4. Such a calendaring process is described herein.

Figure 8:
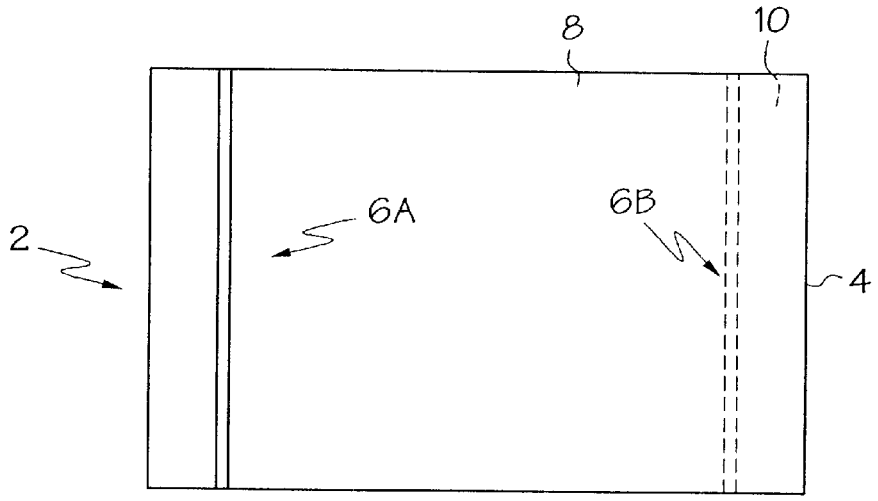
FIGS. 8–15 are enlarged, plan views, of security documents according to further aspects of the present invention.

It should be apparent that more than one simulated security thread 6 may be formed on one or both major surfaces 8, 10 of the substrate 4. Further, the simulated security thread 6 may include one or more of the configurations shown in FIGS. 8–15. Referring to FIG. 8, a first simulated security thread 6A is applied to the first major surface 8 while a second simulated security thread 6B is applied to the second major surface 10. The first and second simulated security threads 6A, 6B may have different colors, widths, shapes, or any combination thereof, to further enhance the security features of the security document 2. For example, the first simulated security thread 6A may be a first color, such as green, and the second simulated security thread 6B may be a second color, such as red.

Figure 9:
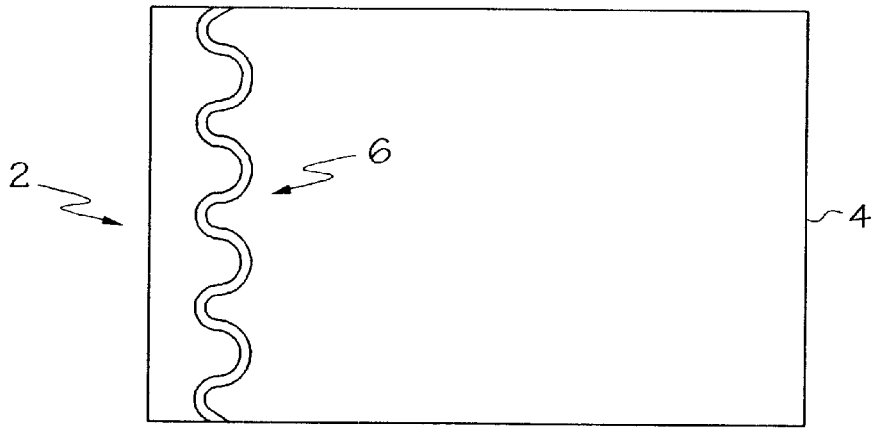
Figure 10:
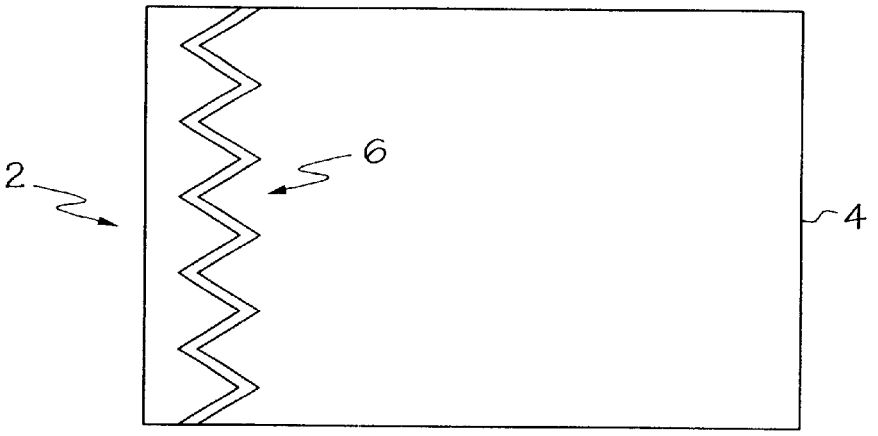

As is shown in the illustrative embodiment of FIG. 8, the first and second simulated security threads 6A, 6B are formed along a substantially straight or linear line within the substrate 4. Alternatively, the simulated security thread 6 may have a curvilinear pattern as is illustrated in FIG. 9. The curvilinear pattern of the simulated security thread 6 may be symmetrical, such as a sinusoidal wave, or an asymmetrical pattern. Similarly, the simulated security thread 6 may comprise a single diagonal line across the first major surface 8 of the substrates 4 or a series of asymmetrical or symmetrical diagonal lines. FIG. 10 illustrates a simulated security thread 6 comprising a series of such symmetrical diagonal lines.

Figure 11:
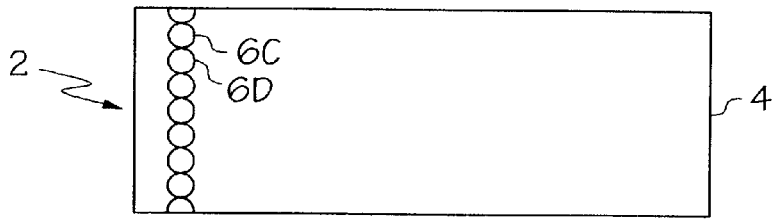

FIG. 11 illustrates a pair of crisscrossing or overlapping simulated security threads 6C, 6D. As with the simulated security threads 6A, 6B of FIG. 8, the simulated security threads 6C, 6D of this FIG. 11 may have different colors, widths, shapes, or any combination of the same to further enhance the security features of the security document 2. The overlapping simulated security threads 6C, 6D may also be symmetrical, asymmetrical, curvilinear, diagonal, or any other reasonable shape. The overlapping simulated security threads 6C, 6D may also be formed on opposite surfaces of the substrate 4, more specifically the first major surface 8 and the second major surface 10, such that they do not physically touch each other.

Figure 12:
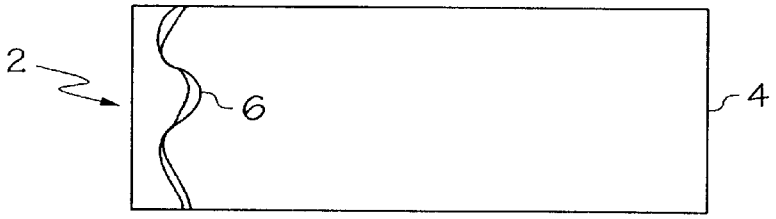

FIG. 12 illustrates a simulated security thread 6 having a varying width. The width of the simulated security thread 6 may be varied as it is applied to the substrate 4. A simulated security thread 6 with a varying width as shown in FIG. 12, further enhances the security features of the security document 2, making it more difficult to forge or duplicate.

Figure 13:
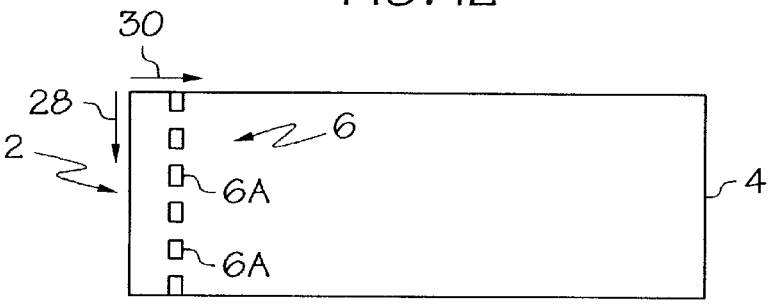

The transparentizing composition 12 may be applied to the substrate 4 to form either a continuous or discontinuous simulated security thread 6. FIG. 13 illustrates a discontinuous simulated security thread 6. The discontinuous simulated security thread 6 is formed of a plurality of individual discrete simulated security threads 6A which can be oriented in any desired manner. The discontinuous simulated security thread 6 may be straight, curvilinear, or zig-zagged. Further, each of the individual simulated security threads 6A may have a different color.

Figure 14:
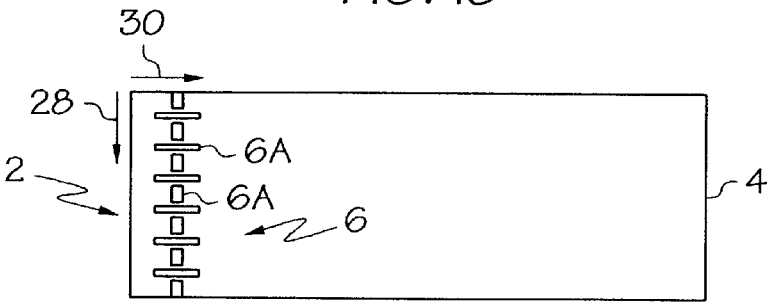
Figure 15:
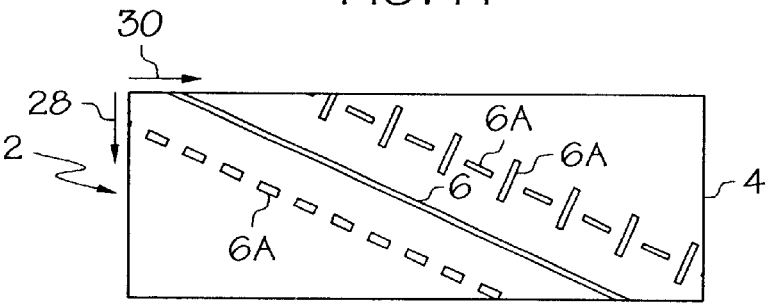

While the individual simulated security threads 6A are shown in FIG. 13 as extending in the machine direction 28, the individual simulated security threads 6A may also be formed along the cross-web direction 30 or interspersed along the machine direction 28 and the cross-web direction 30, as is shown in FIG. 14. When using printing plates, it is possible to apply the transparentizing composition 12 to produce complex patterns of simulated security thread 6 in the substrate 4. These patterns can include continuous or discontinuous simulated security threads that are similar to laid lines. Moreover, as illustrated in FIG. 15, the transparentizing composition 12 can be applied in an orientation that is diagonal between the machine direction 28 and the cross-web direction 30. This is a significant improvement over the known art, which applies actual thread only in a vertical orientation.

The above described alternate embodiments of simulated security threads contain combinations of security features in a single composition printed as a single or a plurality of simulated security threads with multiple functions. However, it is contemplated that distinct printable compositions may be formulated with distinct functionality and printed as separate simulated security threads on a single cellulosic substrate. Thus, the resulting security document may be checked for authenticity by examining each simulated security thread separately.

For the purposes of describing and defining the present invention, a transparentized simulated security thread comprises a localized modification of the structure and opacity of a finished cellulosic substrate so that at least one line can be seen when the sheet is held to the light or otherwise examined. Further, it should be understood that, according to the present invention, the degree of transparency embodied in the transparent simulated security thread may be varied to suit the needs of those practicing the present invention. Further, it is contemplated by the present invention that the multi-functional simulated security threads of the present invention may be combined with other security features.

Regarding the transparentizing composition, it is noted that the composition is described herein in terms of three general formulations. Each formulation is described in detail below. It is contemplated by the present invention, however, that although the below-described compositions embody specific advantages over conventional compositions, any suitable transparentizing composition may be utilized to form the above described simulated security thread of the present invention.

Transparentizing Composition According to One Embodiment of the Present Invention In this embodiment of the present invention, a solventless transparentizing material or composition is provided which penetrates a cellulosic substrate very quickly and completely, and forms a cured polymeric transparentized portion possessing advantageous physical and chemical properties and exhibiting a high degree of transparency. In this manner, a very high-quality transparentized portion can be formed on cellulosic substrates in a fast, continuous, in-line process, without the need for recovering a solvent. Further, this embodiment of the present invention provides a liquid polymerizable transparentizing composition which exhibits good toner adhesion properties and is cured by radiation rather than by thermal polymerization.

The radiation curable transparentizing composition of this embodiment of the present invention comprises at least one monomer selected from the group consisting of acrylate or methacrylate esters of polyhydroxy polyethers made from polyhydric alcohols (polyols) starting materials (compounds of Formula I) and/or acrylate or methacrylate esters of polyhydroxy polyethers made from primary or secondary amine starting materials (compounds of Formula II).

A novel feature of the invention is the use in transparentizing formulations of acrylate and/or methacrylate esters of hydroxy polyethers made by reaction of ethylene and/or propylene oxide with organic compounds having one or more reactive sites, such reactive sites comprising hydroxyl and primary or secondary amine groups. These acrylate/methacrylate esters may be represented by either of the following formulas (I and II):

$$[R''\text{-}\underset{x}{\text{-}}[OCH\overset{R}{\overset{|}{C}}H_2]_n\text{-}OR']_z \qquad \text{(I)}$$

wherein,

R" is any mono- or polyfunctional organic radical;

R is H or $CH_3$;

R' is H or $-C(O)C(R)=CH_2$ with the proviso that $-C(O)C(R)=CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different; and:

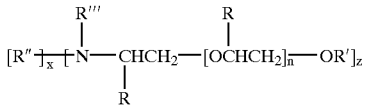

(II)

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R'" is H or a group of the formula:

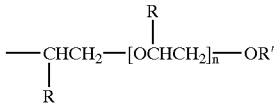

wherein R, R', and n are as defined as above, wherein if any of R, R', R" or R'" are greater than one, their identities and the number of each may be the same or different.

These agents may be used alone, that is, as individual compounds selected from either Formula I or Formula II. Alternatively, these agents may be used as mixtures of compounds of Formula I, mixtures of compounds of Formula II, or as mixtures of compounds of Formula I and compounds of Formula II.

The compounds of Formula I and Formula II are an improvement over known transparentizing agents in that incorporation of the repeating ethylene oxide units renders the them hydrophilic (water-loving) and polar. Due to the increased polarity of these compounds, they exhibit enhanced toner adhesion properties, thus allowing more transparentizing material to be loaded onto the substrate. The ability to load more transparentizing material onto the substrate is highly desirable in that there is a direct relationship between the amount of transparentizing material loaded on the substrate and the degree of transparency achieved in the final product. In addition, radiation curing of the transparentizing material is preferred in that it is faster and more reliable than other forms of curing such as, for example, heat curing. These features thus permit continuous, in-line transparentization. Another advantage of the above-recited transparentizing material is that penetration is achieved without the need for solvents. Thus, the transparentizing material that is applied can be a 100% solid composition, thus eliminating the need for evaporation and recovery of solvent from the substrate.

In the preferred embodiment, the transparentizing material further includes a small amount of water. Generally, the amount of water used in this embodiment constitutes between about 1% to about 15% of the total transparentizing formulation. Unlike most transparentizing agents which are non-polar and therefore not soluble in water, the compounds of Formula I and Formula II form miscible mixtures with small amounts of water. The resulting miscible formulation exhibits increased wetting capabilities, resulting in an increased speed of penetration into the paper substrate and allowing for faster line-speeds. This increased speed of penetration is sufficiently high that faster line-speeds are obtained even taking into account the time necessary to remove the water prior to radiation curing.

A further advantage of the use of the above-recited polymerizable transparentizing compositions is that the transparentized portion produced by the coating is of a high quality. Physically, the transparentized portion is strong and flexible and is highly receptive to inks and/or toner.

The resulting transparentized portion has sufficient resistance to migration and/or volatilization of the radiation cured material that it does not lose its transparency over time. This is believed possible due to the fact that the transparentizing material penetrates the substrate substantially completely. This advantage is believed due to the fact that the applied transparentizing material is 100% solids. The inventors do not, however, wish to be bound to any specific theory of operation of the present invention. An additional factor that is believed to contribute to this advantage is the fact that the transparentizing material can be radiation cured almost immediately after it has been applied to the substrate since it penetrates the substrate so quickly.

Although the radiation curable transparentizing materials of the present embodiment penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer.

Similarly, it may also be necessary in certain situations to have a transparentized portion with extra flexibility. In such situations, an oligomer may be included in the transparentizing material. The preferred oligomers are styrene-acrylic acid oligomers and urethane acrylate oligomers. Whether or not a prepolymer and/or oligomer is included in the transparentizing material, however, it is preferable that the transparentizing material have a refractive index of about 1.5 after the transparentizing material has been cured.

In addition, the radiation curable transparentizing material may include other monomers, such as vinyl ethers and/or acrylate or methacrylate esters of polyhydric alcohols which contain 4 or more acrylate or methacrylate functionalities. Vinyl ethers may be added to the transparentizing material to eliminate odor and to lower the viscosity of the formulation, thereby allowing even faster penetration into the cellulosic substrate. Acrylate or methacrylate esters of polyhydric alcohols which contain 4 or more acrylate or methacrylate functionalities may be added to the transparentizing material to increase the cross-linking density, to lower the viscosity, and to generally increase the rate of curing of the transparentizing material.

As mentioned, the speed at which the above-recited transparentizing material penetrates allows transparentizing to occur in a continuous, in-line process. Such a process may be a continuous flexographic printing process, gravure, or roll-metering process, with flexographic being preferred, in which the step of applying the transparentizing material to the predetermined portion occurs in the continuous printing process. The polymerizable transparentizing compositions of this embodiment of the present invention have a viscosity which makes them suitable as "inks" to be applied by printing techniques. The transparentizing material is then cured immediately thereafter as a subsequent step in the continuous process. Preferably, those steps occur at a speed of about 75 to about 1000 linear feet (i.e., about 23 to about 305 linear meters) of substrate per minute.

Accordingly, it is a feature of this embodiment of the present invention to provide a transparentized cellulosic substrate by the application of a transparentizing material which contains transparentizing agents which are hydrophilic (water-loving) and polar and therefore provide enhanced toner adhesion properties and fast penetration rates. In addition, these transparentizing agents do not form emulsions upon the addition of small amounts of water, and the transparentizing agents which contain small amounts of water exhibit even faster penetration rates. Further, these transparentizing materials may be applied without the need for solvents. Moreover, this embodiment of the present invention also provides a solventless transparentizing material which penetrates the substrate very quickly and completely, and forms a cured polymeric transparentized portion which not only possesses the aforementioned physical and chemical properties, but also exhibits an improved degree of transparency. In this manner, a very high-quality transparentized portion can be formed on cellulosic substrates in a fast, continuous, in-line process, without the need for recovering a solvent. Further this embodiment of the present invention provides liquid polymerizable transparentizing compositions which exhibit good toner adhesion properties and are cured by radiation rather than by thermal polymerization. These features thus permit continuous, in-line transparentization.

The transparentizing agent of this embodiment of the present invention permits formation of a transparentized portion wherein no thinning of the area is required to result in a transparentized portion that does not increase the thickness of substrate. This may be accomplished either by applying localized heat to the substrate, e.g., about 50° C. to about 100° C., prior to the application of the transparentizing material, or by heating the transparentizing material to a temperature of between about 30° C. and about 50° C. prior to application of the transparentizing material to the substrate, or both.

The transparentizing agents of this embodiment of the present invention typically constitute from about 75% to about 95% by weight, and preferably from about 80% to about 90% by weight, of the final transparentizing material. These agents are acrylate and/or methacrylate esters of hydroxy polyethers made by reaction of ethylene and/or propylene oxide with organic compounds having one or more reactive sites, such reactive sites comprising hydroxyl and primary or secondary amine groups, as described above.

As used herein, the term "any organic radical" refers to any organic radical which can be attached to a hydroxyl, primary amine, or secondary amine. Typical examples include mono- or multi-functional aromatic or aliphatic functionalities, wherein the aliphatic functionalities may be unsaturated, saturated, straight, branched, or cyclic in configuration.

Compounds of Formula I and II are commercially available or may be prepared by procedures and techniques well known to one of ordinary skill in the art. For example, compounds of Formula I may be prepared essentially as shown in Scheme A wherein all substituents are as previously defined unless otherwise specified.

SCHEME A

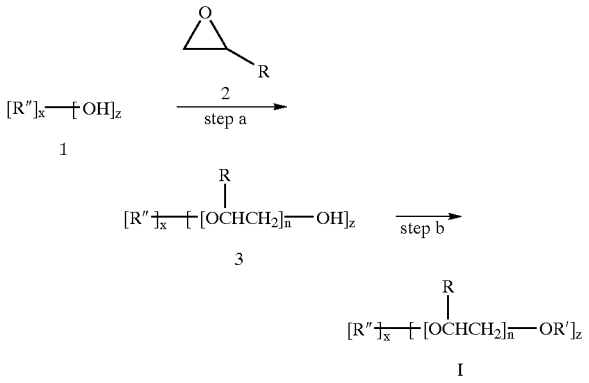

Compounds of Formula I may be prepared by techniques and procedures well known to one of ordinary skill in the art. For example, in Scheme A, step a, a polyhydric alcohol of formula 1 is reacted with an excess of an oxide of formula 2 to give a polyhydroxy polyether of formula 3. In step b, at least one of the hydroxy functionalities of the polyhydroxy polyether of formula 3 is esterified with acryloyl chloride or methacryloyl chloride to give the compounds of Formula I. Although depicted in Scheme A as complete esterification of all hydroxy functionalities of compounds of formula 3, it is understood that by varying the proportion of reagents, reactions times, and reaction temperatures, that some hydroxy functionalities of the compounds of formula 3 will not be esterified. Representative examples of compounds of Formula I are polypropylene glycol monoacrylate, ethoxylated trimethyolpropane triacrylate, and propoxylated neopentyl glycol diacrylate.

Compounds of Formula II may be prepared essentially as in Scheme B wherein all substituents are as previously defined unless otherwise specified.

SCHEME B

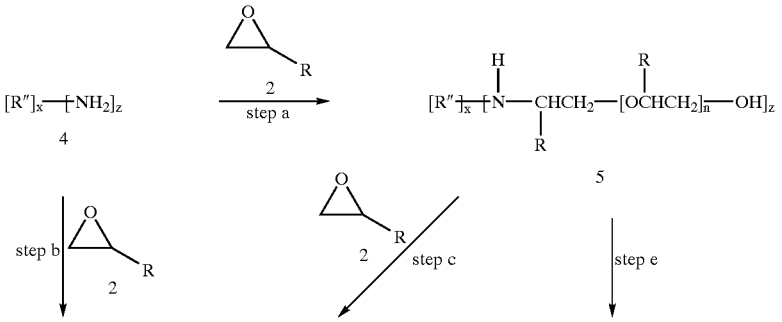

-continued

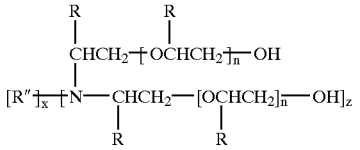

6

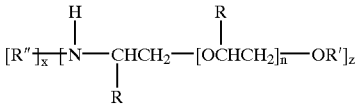

II step d

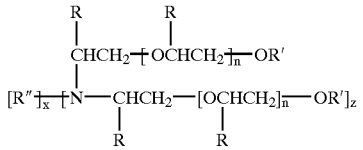

6

The compounds of Formula II may also be prepared by techniques and procedures well known to one of ordinary skill in the art. For example, in Scheme B, step a and step b, a polyhydric amine of formula 4 is reacted with an excess of an oxide of formula 2. Depending upon the proportion of reagents, reaction times, and reaction temperatures, the reaction of step a may result either in the formation of the secondary polyamine polyether of formula 5 as shown in step a or the tertiary polyamine polyether of formula 6 as shown in step b. Alternatively, the tertiary polyamine polyether of formula 6 may be formed from the reaction of the secondary polyamine polyether of formula 5 with excess oxide of formula 2. In step d, at least one hydroxy functionality of the tertiary polyamine polyether of formula 6 is esterified with acryloyl chloride or methacryloyl chloride to give the tertiary polyamine compounds of Formula II. Similarly, in step e, at least one of the hydroxy functionalities of the secondary polyamine polyether of formula 5 is esterified with acryloyl chloride or methacryloyl chloride to give the secondary polyamine compounds of Formula II. Although depicted in Scheme B as complete esterification of all hydroxy functionalities of compounds of formula 5 and 6, it is understood that by varying the proportion of reagents, reactions times and reaction temperatures, that some hydroxy functionalities of the compounds of formula 5 and 6 will not be esterified.

In Scheme A and B, all starting materials and reagents are commercially available or readily available to one of ordinary skill in the art.

When one or more of the monomers of Formula I and/or Formula II, without oligomers or prepolymers, are included in a radiation curable transparentization material, the liquid coating penetrates a cellulosic substrate quite rapidly and can be applied as a "100% solids" and still achieve a rapid rate of penetration. "100% solids" means a liquid material which can be converted 100% to a solid upon curing (i.e., crosslinking or polymerization). Thus, it contains no residual volatiles or solvents. However, if even faster penetration is desired, a polar organic solvent can be added to the coating to lower the viscosity thereof. Preferred solvents are solvents which are polar and miscible with water and include methanol, ethanol, isopropanol, acetone, and other like compounds.

In the preferred embodiment, the radiation curable transparentizing material includes small amounts of water. Typically, in this embodiment, water constitutes from about 1% to about 15% and preferably from about 5% to about 10% by weight of the final composition. As stated previously, unlike most transparentizing agents which are non-polar and therefore not soluble in water, the transparentizing agents of Formula I and Formula II form miscible mixtures with small amounts of water. Prior to exposure to radiation, the water is removed by evaporation with heat at a temperature sufficient to remove water. As one of ordinary skill in the art would realize, the faster the line speed, the higher the temperature required to remove the water. Typically, temperatures at or above 120° C. are utilized with higher line speeds, such as those at or above 500 linear feet per minute.

Preferably, the polymerizable transparentizing composition is cured by exposure to radiation-electron beam radiation, visible radiation, or ultraviolet radiation. Curing causes the polymerizable constituents of the transparentizing composition to polymerize, thus making a permanently transparentized portion. Once the transparentizing material is cured, it is a solid and will not migrate or volatilize. Advantageously, the rapidity with which the present transparentizing material penetrates the substrate allows the material to be cured almost immediately following its application to the substrate, thus providing substantially no opportunity for the material to migrate or volatilize beyond the area to which it has been applied.

If electron beam curing is employed, no photocatalyst is needed. However, if curing it carried out by exposing the transparentizing material to ultraviolet radiation, a photocatalyst needs to be included. Preferably, the photocatalyst is of the free radical type. A wide variety of such photocatalysts can be used provided they do not deleteriously affect the desired physical and chemical properties of the resultant transparentized portion. Examples of useful free radical photocatalysts include an alkyl benzoin ether, such as benzoin ether benzophenone, a benzophenone with an amine such as methyl diethanolaminedimethylquinoxiline 4,4' bis (dimethylamine bezophenone), and acetophenones such as 2,2 diethoxyacetophenone and t-butyl trichloroacetophenone. A preferred class of useful free radical photocatalysts are haloalkyl substituted aryl ketone compounds. All such photocatalysts, useful in the practice of this invention, are either readily available commercially or are easily prepared using known techniques. Typically, when a photocatalyst is used, it will constitute from about 1% to about 15% by weight of the composition.

The speed at which the transparentizing material of this embodiment of the present invention penetrates a substrate allows transparentizing to occur in a continuous, in-line process. Such a process can include any conventional printing method, such as flexographic, gravure, or screen. A continuous transparentization process can be set up in which the transparentizing material is first applied to an area in a flexographic printing press, and then cured immediately thereafter by electron beam radiation, visible radiation, or ultraviolet radiation.

In the case of a flexographic printing press in combination with ultraviolet curing, for example, an acceptable rate of transparentization (i.e., applying the transparentizing material to a substrate, evaporating water if necessary, and curing the material) is from about 75 to about 150 linear feet (i.e., about 23 to about 46 meters) of substrate per minute. Obviously, faster production speeds are usually preferred. One expedient for increasing production speed is to heat the substrate and/or transparentizing material mildly (50° C.–100° C.), effectively reducing viscosity and increasing the penetration rate. The preferred viscosity of the coating at 25° C. is from about 30 to about 100 centipoise and, more preferably, from about 30 to about 70 centipoise. The preferred wavelength of the ultraviolet curing light is from about 200 to about 400 nanometers, and the preferred ultraviolet curing light level is from about 300 to about 600 watts per inch of substrate width.

The transparentizing material can be applied to one or both sides of a substrate. It is preferred, however, that it be applied simultaneously to both sides of an area of the substrate. Such simultaneous application provides even faster penetration of the transparentizing material into the substrate.

Advantageously, the use of one or more of the above-recited compounds of Formula I and Formula II, without oligomers or prepolymers, results in a transparentizing material which not only penetrates a substrate quickly, but also produces a transparentized portion that meets all of the desired physical and chemical properties. Physically, the transparentized portion is strong, flexible, and durable, such that it will maintain its transparency when subjected to rough handling. In addition, the transparentized portion is highly receptive to inks and/or toners.

Chemically, the transparentized portion has sufficient resistance to ultraviolet radiation that it does not lose its transparency over time. This is believed possible due to the fact that the above-recited monomers achieve substantially complete penetration of the substrate. Additionally, the transparentized portion has sufficient resistance to migration and/or volatilization of the radiation cured transparentizing material that it does not lose its transparency over time. Due to the rapid penetration of the transparentizing material into the substrate, the transparentizing material can be cured almost immediately after it has been applied to an area. Moreover, although compatible with polar organic solvents, the transparentizing material of the present embodiment does not require the use of organic solvents. Therefore, it is less volatile after curing than one containing an organic solvent, thus further reducing the tendency to migrate or volatilize.

It is preferred that the transparentizing material, once cured, have a refractive index as close as possible to that of the substrate. This will ensure that the transparentized portion will be sufficiently transparent. Most cellulosic substrates have a refractive index of around 1.5. Thus, the preferred refractive index of the cured coating is similarly around 1.5.

However, some cellulosic substrates have a refractive index which is greater than 1.5. With such substrates, it may be desirable to include one or more prepolymers with the transparentizing material in order to increase the refractive index of the cured transparentizing material to substantially match that of the substrate. Typically, 1.55 is the highest value that the refractive index of the cured transparentizing material will need to attain in this manner. The preferred prepolymers for this function include styrene-maleic anhydride, styrene-acrylic acid, and styrene-methacrylic acid. The most preferred prepolymer of this group is styrene-maleic anhydride.

It may also be desirable in certain situations to have a transparentized portion with extra flexibility. For this purpose, an oligomer may be included with the transparentizing material. The preferred oligomers in this instance are urethane acrylate oligomer and styrene-acrylic oligomer.

Further, an amine may be included with the transparentizing material in order to reduce the curing time thereof. The preferred amine for this purpose is triethanol amine. Alternatively, compounds of Formula II may also be used for this purpose. Typically, when an amine is included in the transparentizing material for this purpose, it will constitute from about 1% to about 7% by weight of the composition.

Still further, a vinyl ether may be included with the transparentizing material to decrease odor. The preferred vinyl ether for this function is vinyl pyrrolidone. When included, a vinyl ether typically will constitute about 5% by weight of the final transparentizing material. It should be noted however, that the use of vinyl ethers is not compatible with the embodiment which includes small amounts of water.

Still further, acrylate or methacrylate esters of polyhydric alcohols which contain 4 or more acrylate or methacrylate functionalities may be added to the transparentizing material to increase the cross-linking density, to lower the viscosity, and to increase somewhat the rate of curing of the transparentizing material. The preferred acrylate or methacrylate esters for this purpose are pentaerythritol tetramethacrylate, dipentaerythritol pentacrylate, and dipentaerythritol deshydroxymethyl pentacrylate. When included, an acrylate or methacrylate ester of this type will typically constitute from about 1% to about 10% by weight of the final transparentizing material.

In order that the invention may be more readily understood, reference is made to the following examples, which are intended to be illustrative of the present embodiment of the invention, but are not intended to be limiting in scope.

EXAMPLE 1

A radiation curable liquid transparentizing material was prepared in accordance with this embodiment of the present invention by blending the materials listed below. The liquid was then applied to a substrate by flexographic printing and cured by ultraviolet radiation at a wavelength of from about 200 to about 400 nanometers.

| | Percent by weight |
|---|---|
| Polypropylene glycol monoacrylate[1] | 60.5 |
| Water | 6.2 |
| Ethoxylated trimethyolpropanetriacrylate[2] | 22.8 |

-continued

| | Percent by weight |
|---|---|
| Triethanolamine | 2.9 |
| Photocatalyst[3] | 7.6 |

[1]SR-604 from Sartomer
[2]SR-415 from Sartomer
[3]Iracure 1173 from Ciba Geigy

EXAMPLE 2

A radiation curable transparentizing liquid was prepared as in Example 1 using the following materials:

| | Percent by weight |
|---|---|
| Polypropylene glycol monoacrylate[1] | 17.5 |
| Water | 6.2 |
| Ethoxylated trimethyolpropanetriacrylate[2] | 65.5 |
| Triethanolamine | 2.9 |
| Photocatalyst[3] | 7.6 |

[1]SR-604 from Sartomer
[2]SR-415 from Sartomer
[3]Iracure 1173 from Ciba Geigy

EXAMPLE 3

A radiation curable transparentizing liquid was prepared as in Example 1 using the following materials:

| | Percent by weight |
|---|---|
| Propoxylated Neopentyl glycol diacrylate[1] | 66.7 |
| Ethoxylated trimethyolpropanetriacrylate[2] | 20.5 |
| Dipentaerythritol pentacrylate[3] | 3.1 |
| Triethanolamine | 2.9 |
| Photocatalyst[4] | 6.8 |

[1]SR-9003 from Sartomer
[2]SR-415 from Sartomer
[3]SR-9041 from Sartomer
[4]Iracure 500 or 1173 from Ciba Geigy

EXAMPLE 4

A radiation curable transparentizing liquid was prepared as in Example 1 using the following materials:

| | Percent by weight |
|---|---|
| Propoxylated Neopentyl glycol diacrylate[1] | 66.7 |
| Ethoxylated trimethyolpropanetriacrylate[2] | 20.5 |
| Dipentaerythritol pentacrylate[3] | 3.1 |
| Photocatalyst[4] | 9.7 |

[1]SR-9003 from Sartomer
[2]SR-415 from Sartomer
[3]SR-9041 from Sartomer
[4]Iracure 500 or 1173 from Ciba Geigy

Transparentizing Composition According to Another Embodiment of the Present Invention In this embodiment of the present invention, a solventless transparentizing material is provided which penetrates a cellulosic substrate very quickly and completely, and forms a cured polymeric transparentized portion possessing advantageous physical and chemical properties and exhibiting a high degree of transparency. In this manner, a very high-quality transparentized portion can be formed on cellulosic substrates in a fast, continuous, in-line process, without the need for recovering a solvent. Further, this embodiment of the present invention provides a liquid polymerizable transparentizing compositions which exhibits good toner adhesion properties and is cured by radiation rather than by thermal polymerization and which cure both rapidly and completely. In addition, the liquid polymerizable transparentizing compositions of this embodiment of the present invention exhibit minimal odor and skin-irritating qualities.

The radiation curable transparentizing composition of this embodiment of the present invention comprises a free-radical catalyzable constituent; a cationic catalyzable constituent; and a catalyst. As used herein, the term "cationic catalyzable constituent" refers to a vinyl ether, a polyepoxide, a mixture of vinyl ethers, a mixture of polyepoxides, or a mixture of at least one of a vinyl ether and at least one of a polyepoxide. As used herein, the term "free radical catalyzable constituent" refers to compounds of the following formula or mixtures of compounds of the following formula:

$$[R'']_x-[OCH\overset{R}{C}H_2]_n-OR']_z$$

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different.

As used herein, the term "catalyst" refers to a photocatalyst selected from a free radical catalyst, a mixture of free radical catalysts, a living cationic catalyst, a mixture of living cationic catalysts, or mixtures of at least one of a free radical catalyst and at least one of a living cationic catalyst.

Thus, in one embodiment, there is provided a method of transparentizing a cellulosic substrate which comprises the steps of a) providing a cellulosic substrate; b) applying to at least one surface of the substrate a transparentizing composition comprising: 1) at least one of a polyepoxide; 2) and at least one of a compound or mixture of compounds of Formula I; and 3) at least one of a free radical catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a free radical catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a polyepoxide; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a polyepoxide; 2) at least one of a compound of Formula I; and 3) at least one of a free radical catalyst in admixture with at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether; 2) at least one of a compound of Formula I; and 3) at least one of a free radical catalyst in admixture with at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a free radical catalyst in admixture with at least one of a living cationic catalyst; and c) curing the transparentizing composition with radiation.

An advantage of the use of the above-recited polymerizable transparentizing compositions is that the transparentized portion produced by the coating is of a high quality. Physically, the transparentized portion is strong and flexible and is highly receptive to inks and/or toner.

The resulting transparentized portion has sufficient resistance to migration and/or volatilization of the radiation cured material that it does not lose its transparency over time. This is believed possible due to the fact that the transparentizing material penetrates the substrate substantially completely. This advantage is believed due to the fact that the applied transparentizing material is 100% solids. The inventors do not, however, wish to be bound to any specific theory of operation of the present invention. An additional factor that is believed to contribute to this advantage is the fact that the transparentizing material can be radiation cured almost immediately after it has been applied to the substrate since it penetrates the substrate so quickly.

Although the radiation curable transparentizing materials of this embodiment of the present invention penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer.

Similarly, it may be necessary in certain situations to have a transparentized portion with extra flexibility. In such situations, an oligomer may be included in the transparentizing material. The preferred oligomers are styrene-acrylic acid oligomers or urethane acrylate oligomers.

In addition to the foregoing, this embodiment of the present invention provides a method of transparentizing a predetermined portion or portions of a cellulosic substrate, preferably such that a smooth interface exists between the transparentized portion and the remainder of the substrate, and preferably such that the transparentized portion has a thickness which is no greater than the thickness of the remainder of the substrate. In some embodiments, the method comprises making a predetermined portion of the substrate thinner than the remainder of the substrate such that the predetermined portion is rendered substantially transparent, and applying a transparentizing material to the predetermined portion. In other embodiments, the method comprises heating the transparentizing material prior to application to the predetermined portion of the substrate, heating the predetermined portion of the substrate prior to application of the transparentizing material, or heating both the transparentizing material and the predetermined portion of the substrate prior to application of the transparentizing material.

As mentioned, the speed at which the above-recited transparentizing material penetrates allows transparentizing to occur in a continuous, in-line process. Such a process may be a continuous flexographic printing process, gravure, or roll-metering process, with flexographic being preferred, in which the step of applying the transparentizing material to the predetermined portion occurs in the continuous printing process. The polymerizable transparentizing compositions of this embodiment of the present invention have a viscosity which makes them suitable as "inks" to be applied by printing techniques. The transparentizing composition is then cured immediately thereafter as a subsequent step in the continuous process. Preferably, those steps occur at a speed of about 75 to about 1000 linear feet (i.e., about 23 to about 305 linear meters) of substrate per minute.

To provide even faster penetration of the transparentizing material into the substrate, the step of applying the transparentizing material to the predetermined portion can occur simultaneously to both the upper and lower surfaced of the predetermined portion. The transparentizing agent of this embodiment of the present invention permits formation of a transparentized portion wherein no thinning of the area is required to result in a transparentized portion that does not increase the thickness of substrate. This may be accomplished either by applying localized heat to the substrate, e.g., about 50° C. to about 100° C., prior to the application of the transparentizing material, or by heating the transparentizing material to a temperature of between about 30° C. and about 50° C. prior to application of the transparentizing material to the substrate, or both.

The radiation curable transparentizing composition of the present embodiment of this embodiment of the present invention comprises a free-radical catalyzable constituent; a cationic catalyzable constituent; and a catalyst, as described above. As is stated above, the free radical catalyzable constituents for use in this embodiment of the present invention may be represented by the following formula:

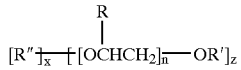

wherein,

R" is any mono- or polyfunctional organic radical;

R is H or $CH_3$;

R' is H or —C(O)C(R)=$CH_2$ with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different.

As used herein, the term "any organic radical" refers to any organic radical which can be attached to a hydroxyl moiety. Typical examples include mono- or multi-functional aromatic or aliphatic functionalities, wherein the aliphatic functionalities may be unsaturated, saturated, straight, branched, or cyclic in configuration.

Examples of compounds of Formula I wherein n=0 include ethylene glycol diacrylate, ethylene glycol dimethacrylate, pentaerythritol tetramethacrylate, dipentaerythritol hydroxy pentacrylate, pentacrylate, diethylene glycol dimethacrylate, 1,6-hexane diacrylate, trimethylolpropane triacrylate, and tripropyleneglycol diacrylate, all of which are commercially available or readily prepared by techniques and procedures well known to one of ordinary skill in the art. For example, tripropylene glycol diacrylate is available from Sartomer or Radcure, and pentacrylate is available as SR-2041 from Sartomer.

In addition, compounds of Formula I wherein n is an integer 1–20 may be prepared essentially as shown in Scheme A wherein all substituents are as previously defined unless otherwise specified.

SCHEME A

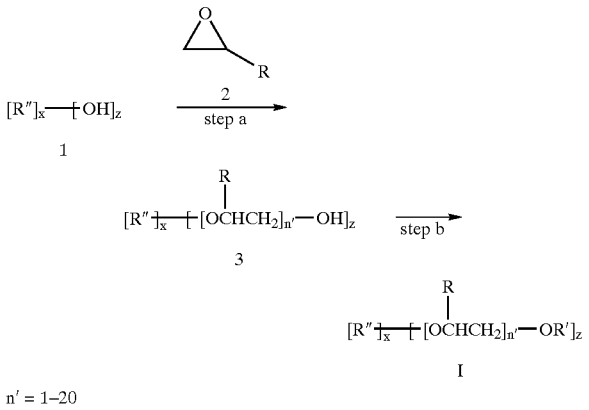

In Scheme A, step a, a polyhydric alcohol of formula 1 is reacted with an excess of an oxide of formula 2 to give a polyhydroxy polyether of formula 3. In step b, at least one of the hydroxy functionalities of the polyhydroxy polyether of formula 3 is esterified with acryloyl chloride or methacryloyl chloride to give the compounds of Formula I. Although depicted in Scheme A as complete esterification of all hydroxy functionalities of compounds of formula 3, it is understood that by varying the proportion of reagents, reactions times, and reaction temperatures, that some hydroxy functionalities of the compounds of formula 3 will not be esterified.

The compounds of Formula I may be used in the polymerizable transparentizing composition as individual compounds selected from Formula I or as mixtures of compounds selected from Formula I.

Suitable polyepoxides for use in this embodiment of the present invention are cycloaliphatic polyepoxides and include, but are not limited to the following:

1

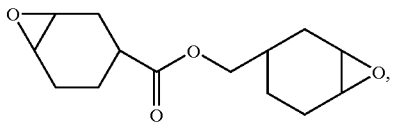

2

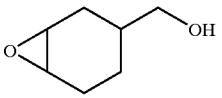

and

3

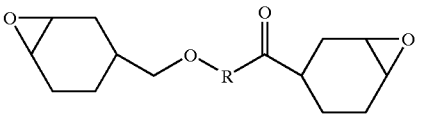

wherein R is a straight or branched chain, saturated or unsaturated $C_1$–$C_6$ alkyl. These cycloaliphatic polyepoxides are either commercially available or readily prepared by methods well known to those skilled in the art. For example, cycloaliphatic polyepoxide 1 is available as UVR-6110 from Union Carbide. These cycloaliphatic polyepoxides may be used in the polymerizable transparentizing composition as individual cycloaliphatic polyepoxides or as mixtures of cycloaliphatic polyepoxides. The linear cycloaliphatic diepoxides 3 are available from UCB Chemical Group, under the tradename E-CADE. The methyl hydroxy cycloaliphatic epoxide 2 is available as ETHB from UCB Chemical Group.

Suitable vinyl ethers for use in this embodiment of the present invention include, but are not limited to, vinyl pyrrolidone, hydroxybutyl vinyl ether, cyclohexandimethanol divinyl ether, polyester vinyl ether, fluoroalkyl vinyl ether, urethane divinyl ether, triethyleneglycol divinyl ether, vinyl/ether terminated urethane monomers and oligomers, and vinyl ether terminated ester monomers and oligomers. These vinyl ethers may be used in the polymerizable transparentizing composition as individual vinyl ethers or mixtures of vinyl ethers.

A wide variety of free-radical catalysts can be used provided they do not deleteriously affect the desired physical and chemical properties of the resultant transparentized portion. Suitable free radical catalysts for use in this embodiment of the present invention include, but are not limited to, xanthones, such as benzoin; ether, benzyldimethoxy ketone; acetophenones, such as 2,2 diethoxyacetophenone and t-butyl trichloroacetophenone; alkyl benzoin ethers, such as benzoin ether benzophenone; a benzophenone with an amine, such as methyl diethanolaminedimethylquinoxiline, 4,4'-bis(dimethylaminebenzophenone), and chloroacetophenone. A preferred class of useful free radical photocatalysts are haloalkyl substituted aryl ketone compounds. All such photocatalysts, useful in the practice of this invention, are either readily available commercially or are easily prepared using known techniques. For example, free radical catalyst 2-hydroxy-1-[4-(hydroxy-ethoxy)phenyl]-2-methyl-1-propane is available as Iracure 2959 from Ciba Geigy. The free radical catalysts may be used in the polymerizable transparentizing composition as individual free radical catalysts or as mixtures of free radical catalysts.

Suitable living cationic catalysts for use in this embodiment of the present invention include those that may be chosen from the family of triarylsulfonium salts or the family of diaryl iodonium salts, which may be expressed by the general formula: $[Ar_xQ^+]_y Z_y^-$, where Ar is an aromatic radical, each independently having optional substitution; Q is a sulfur atom or iodine atom; x is 3 when Q is a sulfur atom; x is 2 when Q is an iodine atom; y is 1 or 2; and Z is $SbF_6$ or $PF_6$.

Representative living cationic catalysts of Formula III for use in this embodiment of the present invention include the following:

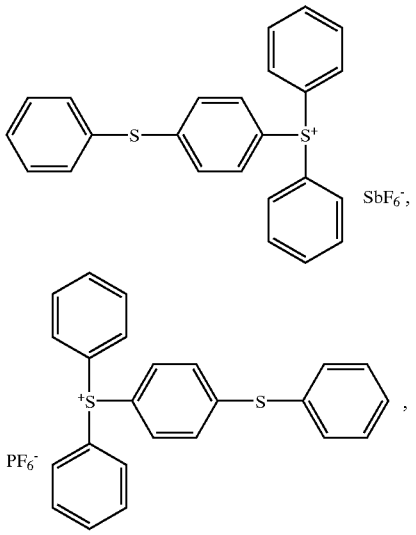

-continued

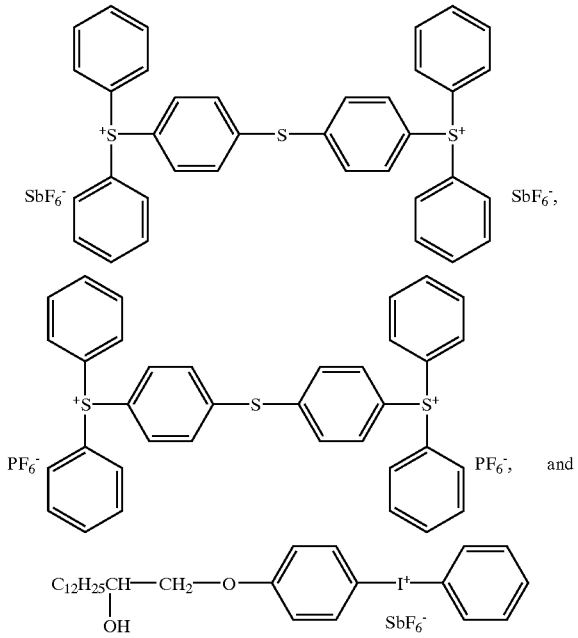

These living cationic catalysts are either commercially available or readily prepared by one of ordinary skill in the art. For example, a triarylsulfoniumhexafluoroantimonate salt is available as UVI 6974 from Union Carbide and a triarylsulfoniumhexafluorophosphate salt is available as UVI 6990 from Union Carbide or as CD-1011, available from Sartomer. These living cationic catalysts may be used in the polymerizable transparentizing composition as individual living cationic catalysts or as mixtures of living cationic catalysts.

As one of ordinary skill in the art will recognize, the polyepoxide and vinyl ether constituents of the polymerizable transparentizing agents are particularly amenable to cationic catalysis whereas the acrylate and methacrylate esters of Formula I are particularly amenable to free radical catalysis. Therefore, when a dual catalyst system (i.e., both free radical and living cationic) is utilized, the polymerizable transparentizing composition may include approximately equal amounts of free radical catalyzable constituent and cationic catalyzable constituent. However, when only a free radical catalyst is utilized, for optimum results, the predominate monomer in the transparentizing composition should be the free radical catalyzable constituent. And when only a living cationic catalyst is utilized, for optimum results, the predominate monomer in the transparentizing composition should be the cationic catalyzable constituent.

Although the radiation curable transparentizing materials of this embodiment of the present invention penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer.

Similarly, it may also be necessary in certain situations to have a transparentized portion with extra flexibility. In such situations, an oligomer may be included in the polymerizable transparentizing composition as part of the free radical catalyzable reactant material. Suitable oligomers are aromatic or non-aromatic acrylates or methacrylates and include, for example, urethane acrylates, such as EBECRYL™ 6700 and EBECRYL™ 270, available from Rad-Cure; urethane methacrylates; epoxy acrylates, such as EBECRYL™ 3500 and EBECRYL™ 3201, available from Rad-Cure; epoxy methacrylates; polyester acrylates; polyester methacrylates; and mixtures thereof. These oligomers are commercially available or readily prepared by techniques and procedures well known to one of ordinary skill in the art. As used herein, the term "oligomer and/or prepolymer component" refers to an individual oligomer, an individual prepolymer, a mixture of individual oligomers, a mixture of individual prepolymers, and a mixture of at least one of an oligomer and at least one of a prepolymer.

Without oligomers or prepolymers, the radiation curable transparentization material of this embodiment of the present invention penetrates a cellulosic substrate quite rapidly and can be applied as a "100% solids" and still achieve a rapid rate of penetration. "100% solids" means a liquid material which can be converted 100% to a solid upon curing (i.e., crosslinking or polymerization). Thus, it contains no residual volatiles or solvents. However, if even faster penetration is desired, a polar organic solvent can be added to the coating to lower the viscosity thereof. Preferred solvents are solvents which are polar and miscible with water and include methanol, ethanol, isopropanol, acetone, and the like.

The polymerizable transparentizing composition may further include from about 0.2% to about 1% of an additive to reduce surface tension of the polymerizable liquid transparentizing material in order to increase the rate of penetration into the substrate, thus increasing production speed. These additives may be used in the polymerizable transparentizing composition as individual additives or as mixtures of additives. Suitable additives are fluorocarbons, such as FC-171 and FC-129, available from 3M, or silicon prepolymers, such as SILRET 77 or DC-90, available from Union Carbide.

The radiation curable transparentizing composition of this embodiment of the present invention, without oligomers, prepolymers, or additives, comprises from about 10% to about 50% of a cationic catalyzable constituent; from about 40% to about 80% of a free radical catalyzable constituent; and from about 5% to about 16% of a catalyst constituent. Thus, a typical transparentizing composition of this embodiment of the present invention, without oligomers, prepolymers, or additives comprises 1) from about 10% to about 50% of any of a vinyl ether, polyepoxide, mixtures of vinyl ethers, mixtures of polyepoxides, or a mixture of at least one of a vinyl ether and at least one of a polyepoxide; 2) from about 40% to about 80% of at least one of a compound of Formula I; and 3) from about 5% to about 16% of at least one of a free radical catalyst, at least one of a living cationic catalyst, or a mixture of at least one of a free radical catalyst and at least one of a living cationic catalyst.

Thus, according to the above, typical radiation curable transparentizing compositions, without oligomers, prepolymers, or additives, are exemplified by the following examples 1–8:

EXAMPLE 1 a) from about 25% to about 40% of at least one of a polyepoxide;

b) from about 40% to about 60% of at least one of a compound of Formula I; and c) from about 5% to about 10% of at least one of a free radical catalyst.

EXAMPLE 2 a) from about 30% to about 35% of at least one of a polyepoxide;

b) from about 55% to about 60% of at least one of a compound of Formula I; and c) from about 8% to about 10% of at least one of a living cationic catalyst.

EXAMPLE 3 a) from about 30% to about 40% of at least one of a polyepoxide;

b) from about 50% to about 60% of at least one of a compound of Formula I;

c) from about 3% to about 8% of at least one of a free radical catalyst; and d) from about 3% to about 8% of at least one of a living cationic catalyst.

EXAMPLE 4 a) from about 10% to about 30% of at least one of a vinyl ether;

b) from about 60% to about 70% of at least one of a compound of Formula I; and c) from about 8% to about 12% of at least one of a living cationic catalyst.

EXAMPLE 5 a) from about 10% to about 20% of at least one of a vinyl ether;

b) from about 60% to about 70% of at least one of a compound of Formula I;

c) from about 5% to about 6% of at least one of a free radical catalyst; and d) from about 5% to about 7% of at least one of a living cationic catalyst.

EXAMPLE 6 a) from about 20% to about 30% of at least one of a polyepoxide;

b) from about 10% to about 15% of at least one of a vinyl ether;

c) from about 40% to about 50% of at least one of a compound of Formula I; and d) from about 5% to about 10% of at least one of a living cationic catalyst.

EXAMPLE 7 a) from about 20% to about 30% of at least one of a polyepoxide;

b) from about 10% to about 15% of at least one of a vinyl ether;

c) from about 40% to about 50% of at least one of a compound of Formula I; and d) from about 8% to about 10% of at least one of a free radical catalyst.

EXAMPLE 8 a) from about 20% to about 30% of at least one of a polyepoxide;

b) from about 10% to about 15% of at least one of a vinyl ether;

c) from about 40% to about 45% of at least one of a compound of Formula I;

d) from about 4% to about 6% of at least one of a free radical catalyst; and e) from about 8% to about 10% of at least one of a living cationic catalyst.

The radiation curable transparentizing composition of this embodiment of the present invention, without oligomers or prepolymers, but with additives, comprises from about 10% to about 50% of a cationic catalyzable constituent; from about 40% to about 80% of a free radical catalyzable constituent; from about 5% to about 13% of a catalyst constituent; and from about 0.5% to about 3% of an additive constituent. Thus, a typical transparentizing composition of this embodiment of the present invention, without oligomers or prepolymers, but with additives comprises 1) from about 10% to about 50% of any of a vinyl ether, polyepoxide, mixtures of vinyl ethers, mixtures of polyepoxides, or a mixture of at least one of a vinyl ether and at least one of a polyepoxide; 2) from about 40% to about 80% of at least one of a compound of Formula I; 3) from about 5% to about 13% of at least one of a free radical catalyst, at least one of a living cationic catalyst, or a mixture of at least one of a free radical catalyst and at least one of a living cationic catalyst; and 4) from about 0.5% to about 3% of an additive or a mixture of additives.

Thus, according to the above, typical radiation curable transparentizing compositions, without oligomers or prepolymers, but with an additive are exemplified by the following examples 9–16:

EXAMPLE 9 a) from about 25% to about 35% of at least one of a polyepoxide;

b) from about 50% to about 70% of at least one of a compound of Formula I;

c) from about 5% to about 10% of at least one of a free radical catalyst; and d) from about 1% to about 3% of an additive or a mixture of additives.

EXAMPLE 10 a) from about 30% to about 35% of at least one of a polyepoxide;

b) from about 50% to about 55% of at least one of a compound of Formula I;

c) from about 8% to about 10% of at least one of a living cationic catalyst; and d) from about 1% to about 2% of an additive or a mixture of additives.

EXAMPLE 11 a) from about 25% to about 40% of at least one of a polyepoxide;

b) from about 40% to about 60% of at least one of a compound of Formula I;

c) from about 2% to about 5% of at least one of a free radical catalyst;

d) from about 4% to about 6% of at least one of a living cationic catalyst; and e) from about 1% to about 2% of an additive or a mixture of additives.

EXAMPLE 12 a) from about 10% to about 20% of at least one of a vinyl ether;

b) from about 60% to about 70% of at least one of a compound of Formula I;

c) from about 8% to about 10% of at least one of a living cationic catalyst; and d) from about 1% to about 2% of an additive or a mixture of additives.

EXAMPLE 13 a) from about 10% to about 20% of at least one of a vinyl ether;

b) from about 60% to about 70% of at least one of a compound of Formula I;

c) from about 5% to about 6% of a free radical catalyst;

d) from about 5% to about 7% of at least one of a living cationic catalyst; and e) from about 1% to about 2% of an additive or a mixture of additives.

EXAMPLE 14 a) from about 20% to about 30% of at least one of a polyepoxide;

b) from about 10% to about 15% of at least one of a vinyl ether;

c) from about 40% to about 50% of at least one of a compound of Formula I;

d) from about 5% to about 10% of at least one of a living cationic catalyst; and e) from about 0.5% to about 1% of an additive or a mixture of additives.

EXAMPLE 15 a) from about 20% to about 30% of at least one of a polyepoxide;

b) from about 10% to about 15% of at least one of a vinyl ether;

c) from about 40% to about 50% of at least one of a compound of Formula I;

d) from about 5% to about 10% of at least one of a free radical catalyst; and e) from about 0.5% to about 1% of an additive or a mixture of additives.

EXAMPLE 16 a) from about 20% to about 30% of at least one of a polyepoxide;

b) from about 10% to about 15% of at least one of a vinyl ether;

c) from about 40% to about 45% of at least one of a compound of Formula I;

d) from about 3% to about 5% of at least one of a free radical catalyst;

e) from about 6% to about 8% of at least one of a living cationic catalyst; and f) from about 0.5% to about 1% of an additive or a mixture of additives.

The radiation curable transparentizing composition of this embodiment of the present invention, with oligomers and/or prepolymers, but without additives, comprises from about 10% to about 50% of a cationic catalyzable constituent; from about 40% to about 80% of a free radical catalyzable constituent; from about 5% to about 13% of a catalyst constituent; and from about 2% to about 50%, preferably from about 2% to about 12% of an oligomer and/or prepolymer component. Thus, a typical transparentizing composition of this embodiment of the present invention, with oligomers and/or prepolymers, but without additives comprises 1) from about 10% to about 50% of any of a vinyl ether, polyepoxide, mixtures of vinyl ethers, mixtures of polyepoxides, or a mixture of at least one of a vinyl ether and at least one of a polyepoxide; 2) from about 40% to about 80% of at least one of a compound of Formula I; 3) from about 5% to about 13% of at least one of a free radical catalyst, at least one of a living cationic catalyst, or a mixture of at least one of a free radical catalyst and at least one of a living cationic catalyst; and 4) from about 2% to about 50%, preferably from about 2% to about 12% of an oligomer and/or prepolymer component.

Thus, according to the above, typical radiation curable transparentizing compositions, with oligomers, prepolymers, but without an additive component are exemplified by the following examples 17–24:

EXAMPLE 17 a) from about 25% to about 35% of at least one of a polyepoxide;
b) from about 50% to about 70% of at least one of a compound of Formula I;
c) from about 4% to about 6% of at least one of a free radical catalyst; and
d) from about 3% to about 6% of an oligomer and/or prepolymer component.

EXAMPLE 18 a) from about 30% to about 35% of at least one of a polyepoxide;
b) from about 50% to about 55% of at least one of a compound of Formula I;
c) from about 5% to about 10% of at least one of a living cationic catalyst; and
d) from about 5% to about 8% of an oligomer and/or prepolymer component.

EXAMPLE 19 a) from about 30% to about 40% of at least one of a polyepoxide;
b) from about 50% to about 60% of at least one of a compound of Formula I;
c) from about 3% to about 4% of at least one of a free radical catalyst;
d) from about 4% to about 6% of at least one of a living cationic catalyst; and
e) from about 3% to about 4% of an oligomer and/or prepolymer component.

EXAMPLE 20 a) from about 12% to about 20% of at least one of a vinyl ether;
b) from about 60% to about 70% of at least one of a compound of Formula I;
c) from about 8% to about 10% of at least one of a living cationic catalyst; and
d) from about 5% to about 10% of an oligomer and/or prepolymer component.

EXAMPLE 21 a) from about 10% to about 20% of at least one of a vinyl ether;
b) from about 60% to about 70% of at least one of a compound of Formula I;
c) from about 5% to about 6% of at least one of a free radical catalyst;
d) from about 5% to about 7% of at least one of a living cationic catalyst; and
e) from about 4% to about 5% of an oligomer and/or prepolymer component.

EXAMPLE 22 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a living cationic catalyst; and
e) from about 4% to about 5% of an oligomer and/or prepolymer component.

EXAMPLE 23 a) from about 20% to about 30% of at least one of a polyepoxide;
b) from about 10% to about 15% of at least one of a vinyl ether;
c) from about 40% to about 45% of at least one of a compound of Formula I;
d) from about 8% to about 10% of at least one of a free radical catalyst; and
e) from about 4% to about 5% of an oligomer and/or prepolymer component.

EXAMPLE 24 a) from about 20% to about 30% of at least one of a polyepoxide;
b) from about 10% to about 15% of at least one of a vinyl ether;
c) from about 40% to about 45% of at least one of a compound of Formula I;
d) from about 3% to about 5% of at least one of a free radical catalyst;
e) from about 6% to about 8% of at least one of a living cationic catalyst; and
f) from about 3% to about 5% of an oligomer and/or prepolymer component.

The radiation curable transparentizing composition of this embodiment of the present invention, with oligomers and/or prepolymers, and with additives, comprises from about 10% to about 50% of a cationic catalyzable constituent; from about 30% to about 80% of a free radical catalyzable constituent; from about 5% to about 13% of a catalyst constituent; from about 1% to about 50%, preferably from about 1% to about 10% of an oligomer and/or prepolymer component; and from about 0.2% to about 2% of an additive. Thus, a typical transparentizing composition of this embodiment of the present invention, with oligomers and/or prepolymers, and with additives comprises 1) from about 10% to about 50% of any of a vinyl ether, polyepoxide, mixtures of vinyl ethers, mixtures of polyepoxides, or a mixture of at least one of a vinyl ether and at least one of a polyepoxide; 2) from about 30% to about 80% of at least one of a compound of Formula I; 3) from about 5% to about 13% of at least one of a free radical catalyst, at least one of a living cationic catalyst, or a mixture of at least one of a free radical catalyst and at least one of a living cationic catalyst; 4) from about 1% to about 50%, preferably from about 1% to about 10% of an oligomer and/or prepolymer component; and 5) from about 0.2% to about 2% of an additive or a mixture of additives.

Thus, according to the above, typical radiation curable transparentizing compositions, with oligomers and/or prepolymers and with an additive component are exemplified by the following examples 25–32:

EXAMPLE 25 a) from about 25% to about 35% of at least one of a polyepoxide;
b) from about 50% to about 70% of at least one of a compound of Formula I;
c) from about 4% to about 6% of at least one of a free radical catalyst;
d) from about 3% to about 5% of an oligomer and/or prepolymer component; and
e) from about 0.5% to about 2% of an additive or a mixture of additives.

EXAMPLE 26 a) from about 30% to about 35% of at least one of a polyepoxide;
b) from about 50% to about 55% of at least one of a compound of Formula I;
c) from about 5% to about 10% of at least one of a living cationic catalyst;
d) from about 5% to about 8% of an oligomer and/or prepolymer component; and
e) from about 1% to about 2% of an additive or a mixture of additives.

EXAMPLE 27 a) from about 10% to about 30% of at least one of a polyepoxide;
b) from about 30% to about 60% of at least one of a compound of Formula I;
c) from about 3% to about 6% of at least one of a free radical catalyst;
d) from about 2% to about 6% of at least one of a living cationic catalyst;
e) from about 1% to about 10% of an oligomer and/or prepolymer component; and
f) from about 0.2% to about 1% of an additive or a mixture of additives.

EXAMPLE 28 a) from about 10% to about 20% of at least one of a vinyl ether;
b) from about 60% to about 70% of at least one of a compound of Formula I;
c) from about 8% to about 10% of at least one of a living cationic catalyst;
d) from about 5% to about 10% of an oligomer and/or prepolymer component; and
e) from about 1% to about 2% of an additive or a mixture of additives.

EXAMPLE 29 a) from about 10% to about 20% of at least one of a vinyl ether;
b) from about 60% to about 70% of at least one of a compound of Formula I;
c) from about 5% to about 6% of at least one of a free radical catalyst;
d) from about 5% to about 7% of at least one of a living cationic catalyst;
e) from about 4% to about 5% of an oligomer and/or prepolymer component; and
f) from about 1% to about 2% of an additive or a mixture of additives.

EXAMPLE 30 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a living cationic catalyst;
e) from about 4% to about 6% of an oligomer and/or prepolymer component; and
f) from about 0.5% to about 1% of an additive or a mixture of additives.

EXAMPLE 31 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a free radical catalyst;
e) from about 4% to about 6% of an oligomer and/or prepolymer component; and
f) from about 0.5% to about 1% of an additive or a mixture of additives.

EXAMPLE 32 a) from about 20% to about 30% of at least one of a polyepoxide;
b) from about 10% to about 15% of at least one of a vinyl ether;
c) from about 40% to about 45% of at least one of a compound of Formula I;
d) from about 3% to about 5% of at least one of a free radical catalyst;
e) from about 6% to about 8% of at least one of a living cationic catalyst;
f) from about 3% to about 5% of an oligomer and/or prepolymer component; and g) from about 0.5% to about 1% of an additive or a mixture of additives.

A preferred radiation-curable transparentizing composition of this embodiment of the present invention comprises:

a) from about 30% to about 40% of a polyepoxide of the formula

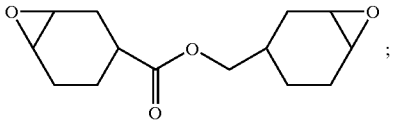

;

b) from about 50% to about 60% of tripropyleneglycol diacrylate;

c) from about 3% to about 6% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

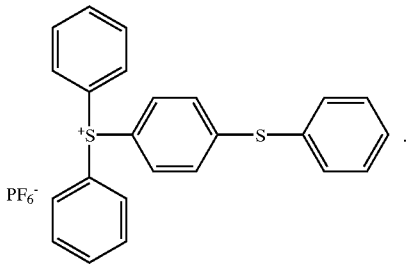

.

A more preferred radiation-curable transparentizing composition of this embodiment of the present invention comprises:

a) from about 30% to about 32% of a polyepoxide of the formula

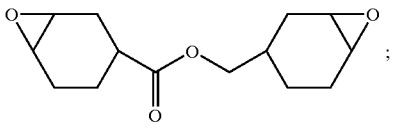

;

b) from about 52% to about 55% of tripropyleneglycol diacrylate;

c) from about 4% to about 5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

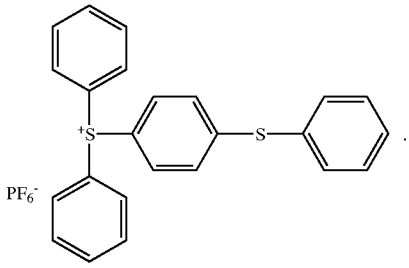

.

A still more preferred radiation-curable transparentizing composition of this embodiment of the present invention comprises:

a) about 31.5% of a polyepoxide of the formula

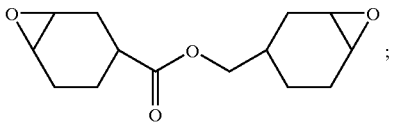

;

b) about 54% of tripropyleneglycol diacrylate;

c) about 4.5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

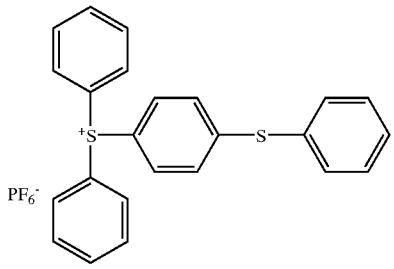

.

Yet a still more preferred radiation-curable transparentizing composition of this embodiment of the present invention comprises:

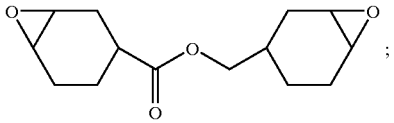

;

a) about 31.5% of a polyepoxide of the formula b) about 54% of tripropyleneglycol diacrylate;

c) about 4.5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

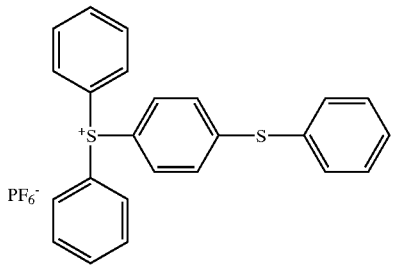

.

Preferably, the polymerizable transparentizing composition is cured by exposure to radiation-electron beam radiation, visible radiation, or ultraviolet radiation. Curing causes the polymerizable constituents of the transparentizing material to polymerize, thus making a permanently transparentized portion. Once the transparentizing composition is cured, it is a solid and will not migrate or volatilize. Advantageously, the rapidity with which the present transparentizing material penetrates the substrate allows the material to be cured almost immediately following its application to the substrate, thus providing substantially no opportunity for the material to migrate or volatilize beyond the area to which it has been applied. The liquid polymerizable transparentizing compositions of this embodiment of the present invention are cured rapidly and completely. For example, transparentizing compositions of this embodiment of the present invention which contain both free radical and living cationic catalysts will typically demonstrate a 95% or greater completion of cross-linking reactions. In addition, compositions containing living cationic catalysts, either alone or in combination with free radical catalysts, will continue to cure to some extent even after exposure to radiation has ceased. And while the application of radiation alone activates both the free radical and living cationic catalysts components of the polymerizable transparentizing composition to initiate cross-linking, the crosslinking rate may be enhanced by the application of heat which may be conveniently provided by infrared radiation. Heat is particularly effective in promoting the activity of the cationic catalyst.

The speed at which the transparentizing material of this embodiment of the present invention penetrates a substrate allows transparentizing to occur in a continuous, in-line process. Such a process can include any conventional printing method, such as flexographic, gravure, or screen. A continuous transparentization process can be set up in which the transparentizing material is first applied to an area in a flexographic printing press, and then cured immediately thereafter by electron beam radiation, visible radiation, or ultraviolet radiation.

In the case of a flexographic printing press in combination with ultraviolet curing, for example, an acceptable rate of transparentization (i.e., applying the transparentizing material to a substrate and curing the material) is from about 75 to about 150 linear feet (i.e., about 23 to about 46 meters) of substrate per minute. Obviously, faster production speeds are usually preferred. One expedient for increasing production speed is to heat the substrate and/or transparentizing material mildly (50° C.–100° C.), effectively reducing viscosity and increasing the penetration rate. The preferred viscosity of the coating at 25° C. is from about 30 to about 100 centipoise and, more preferably, from about 30 to about 70 centipoise. The preferred wavelength of the ultraviolet curing light is from about 200 to about 400 nanometers, and the preferred ultraviolet curing light level is from about 300 to about 600 watts per inch of substrate width.

The transparentizing material can be applied to one or both sides of a substrate. It is preferred, however, that it be applied simultaneously to both sides of the area of the substrate. Such simultaneous application provides even faster penetration of the transparentizing material into the substrate.

Advantageously, the use of polymerizable transparentizing composition of this embodiment of the present invention, without oligomers or prepolymers, results in a transparentizing material which not only penetrates a substrate quickly, but also produces a transparentized portion that meets all of the desired physical and chemical properties. Physically, the transparentized portion is strong, flexible, and durable, such that it will maintain its transparency when subjected to rough handling. In addition, the transparentized portion is highly receptive to inks and/or toners.

Chemically, the transparentized portion has sufficient resistance to ultraviolet radiation that it does not lose its transparency over time. Due to the rapid penetration of the transparentizing material into the substrate, the transparentizing material can be cured almost immediately after it has been applied. Moreover, although compatible with polar organic solvents, the transparentizing material of this embodiment of the present invention does not require the use of organic solvents. Therefore, it is less volatile after curing than one containing an organic solvent, thus further reducing the tendency to migrate or volatilize.

Some cellulosic substrates have a refractive index which is greater than 1.5. With such substrates, it may be desirable to include one or more prepolymers with the transparentizing material in order to increase the refractive index of the cured transparentizing material to substantially match that of the substrate. Typically, 1.55 is the highest value that the refractive index of the cured transparentizing material will need to attain in this manner. The preferred prepolymers for this function include styrene-maleic anhydride, styrene-acrylic acid, and styrene-methacrylic acid. The most preferred prepolymer of this group is styrene-maleic anhydride.

It may also be desirable in certain situations to have a transparentized portion with extra flexibility. For this purpose, an oligomer may be included with the transparentizing material. The preferred oligomers in this instance are urethane acrylate oligomer and styrene-acrylic oligomer.

Transparentizinc Composition According to Another Embodiment of the Present Invention In accordance with the present embodiment of this embodiment of the present invention, a polymeric transparentizing material is provided comprising at least one monomer selected from the group consisting of acrylic esters of polyhydric alcohols, methacrylic esters of polyhydric alcohols, and vinyl ethers which have been cured by exposure to radiation. Such monomers are characterized by having one or more ethylenically unsaturated groups per monomer molecule. In one embodiment, in which the transparentized portion is impregnated with the above-recited radiation curable fluid, the radiation curable fluid is preferably applied as 100% solids (i.e., solventless) liquid. Application in such a manner is advantageous in that the use of the above-recited monomers, without oligomers or prepolymers, causes the liquid to penetrate the cellulosic substrate quickly and completely. In addition, radiation curing of the liquid is preferred in that it is faster and more reliable than other forms of curing such as, for example, heat curing. These features thus permit continuous, in-line transparentization. Another advantage of the above-recited monomeric liquid is that quick penetration is achieved without the need for solvents. Thus, the liquid which is applied can be a 100% solids composition to eliminate the need for evaporation and recovery of solvent from the substrate.

A further advantage of the use of the above-recited monomers, without oligomers or prepolymers, is that even though the liquid penetrates the substrate very quickly, the transparentized portion produced by the coating is of a high quality. Physically, the transparentized portion is strong and flexible and is highly receptive to inks.

Chemically, the transparentized portion of this embodiment of this embodiment of the present invention has sufficient resistance to ultraviolet radiation that it does not yellow and/or lose its transparency over time. It is believed that such resistance to ultraviolet radiation is a result of the aliphatic, as opposed to aromatic, structure of the above-recited monomers. This advantage is believed due to the fact that the liquid which is applied is 100% solids, and the liquid transparentizing material can be radiation cured almost immediately after it has been applied to the substrate since it penetrates the substrate so quickly. The inventors do not, however, wish to be bound to any specific theory of operation of the present invention.

Although the radiation curable transparentizing material of this embodiment of this embodiment of the present invention penetrates the fastest when the above-recited monomers are used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers with the coating if, due to the nature of the cellulosic substrate, for instance, it were necessary to adjust the refractive index of the coating in order to ensure that the cured coating has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer.

Similarly, it may also be necessary in certain situations to have a transparentized portion with extra flexibility. In such situations, an oligomer may be included with the coating. The preferred oligomers are selected from the group consisting of styrene-acrylic acid oligomers and urethane acrylate oligomers.

In some embodiments of the present invention, a predetermined portion of the substrate is made thinner than the remainder of the substrate and a transparentizing material is applied to the predetermined portion. Preferably, such transparentizing coating material comprises one or more monomers selected from the group consisting of acrylic esters of polyhydric alcohols, methacrylic esters of polyhydric alcohols, and vinyl ethers. Preferably, the transparentizing material is a 100% solids radiation curable coating, with the radiation curable coating further including a prepolymer or oligomer. Preferably, the prepolymer is selected from the group consisting of styrene-maleic anhydride prepolymer, styrene-acrylic acid prepolymer, and styrene-methacrylic acid prepolymer. Additionally, the radiation curable coating can include an oligomer such as a urethane acrylate oligomer or a styrene-acrylic oligomer.

As mentioned, the speed at which the above-recited monomeric transparentizing liquid coating penetrates allows transparentizing to occur in a continuous, in-line process. Such a process may be a continuous flexographic printing process in which the step of applying a radiation curable liquid to the predetermined portion occurs in the continuous flexographic printing process. The liquid is then cured immediately thereafter as a subsequent step in the continuous process. Preferably, those steps occur at a speed of about 75 to about 150 linear feet (i.e., about 23 to about 305 linear meters) of substrate per minute.

To provide even faster penetration of the liquid into the substrate, the step of applying a radiation curable liquid to the predetermined portion can occur simultaneously to both the upper and lower surfaces of the predetermined portion.

In rendering the predetermined portion thinner than the remainder of the substrate, that may be accomplished by compressing, such as by calendaring the predetermined portion to a predetermined thickness. Preferably, such predetermined thickness ranges from about 0.0005 to about 0.002 inches following the compression of the predetermined portion. Alternatively, the predetermined portion can be made thinner by mechanically grinding the portion. Preferably, the predetermined portion has a thickness ranging from about 0.0005 to about 0.002 inches following the grinding operation.

According to this embodiment of the present invention, a substrate is impregnated with a radiation curable liquid transparentizing material. The radiation curable liquid comprises one or more monomers selected from the group consisting of vinyl ethers and acrylic and methacrylic esters of polyhydric alcohols. Representative examples include: ethylene glycol diacrylate, ethylene glycol dimethacrylate, trimethylolpropane triacrylate, pentaerythritol tetramethacrylate, dipentaerythritol hydroxy pentacrylate, 1,6-hexanediol diacrylate, and diethylene glycol dimethacrylate. A representative example of a vinyl ether monomer is vinyl pyrrolidone.

Such monomers are aliphatic and have one or more ethylenically unsaturated groups. It has been found that when one or more of these monomers, without oligomers or prepolymers, are included in a radiation curable transparentization coating, the liquid coating penetrates a cellulosic substrate quite rapidly. It is believed that the rapid penetration is due, in part, to the inherently low viscosity of such monomers. Thus, the coating can be a "100% solids" one and still achieve a rapid rate of penetration. "100% solids" means a liquid material which can be converted 100% to a solid upon curing (i.e. crosslinking or polymerization). Thus, it contains no residual volatiles or solvents. However, if even faster penetration is desired, an organic solvent can be added to the coating to further lower the viscosity thereof. Preferred solvents include isopropanol, methyl ethyl ketone, toluene, and hexyl carbitol (hexyl ether of diethylene glycol).

Preferably, the coating is cured by exposure to one of two types of radiation-electron beam radiation or ultraviolet radiation. Curing the coating causes the constituents to polymerize, thus making a permanently transparentized portion. Once the coating is cured, it is a solid and will not migrate or volatilize. Advantageously, the rapidity with which the present liquid transparentizing material penetrates the substrate allows the material to be cured almost immediately following its application to the substrate, thus providing substantially no opportunity for the coating to migrate or volatilize.

If electron beam curing is employed, no photocatalyst is needed. However, if curing is carried out by exposing the coating to ultraviolet radiation, a photocatalyst needs to be included with the coating. Preferably, the photocatalyst is of the free radical type. A wide variety of such photocatalysts can be used provided they do not deleteriously affect the desired physical and chemical properties of the resultant transparentized portion. Examples of useful free radical photocatalysts include an alkyl benzoin ether, such as benzoin ether benzophenone; a benzophenone with an amine, such as methyl diethanolaminedimethylquinoxiline 4,4' bis (dimethylaminebenzophenone); and acetophenones, such as 2,2 diethoxyacetophenone and t-butyl trichloroacetophenone. A preferred class of useful free radical photocatalysts are haloalkyl substituted aryl ketone compounds. All such photocatalysts, useful in the practice of this invention, are either readily available commercially or are easily prepared using known techniques.

The speed at which the monomeric radiation curable liquid of the present invention penetrates the substrate allows transparentizing to occur in a continuous, in-line process. Such a process can include any conventional printing method, such as flexographic, gravure, screen, letterpress, or lithography. A continuous transparentization process can be set up in which the radiation curable liquid is first applied to an area in a flexographic printing press, and then cured immediately thereafter by electron beam radiation or ultraviolet radiation.

In the case of a flexographic printing press in combination with ultraviolet curing, for example, an acceptable rate of transparentization (i.e., applying the coating to the substrate and curing the material) is from about 75 to about 150 linear feet (i.e., about 23 meters to about 46 meters) of substrate per minute. Obviously, faster production speeds are usually preferred. One expedient for increasing production speed is to heat the substrate and/or liquid material mildly (50–90° C.), effectively reducing viscosity and increasing the penetration rate. The preferred viscosity of the coating at 25° C. is from about 50 to about 100 centipoise and, more preferably, from about 50 to about 70 centipoise. The preferred wavelength of the ultraviolet curing light is from about 200 to about 400 nanometers, and the preferred ultraviolet curing light level is from about 300 to about 400 watts per inch of substrate width.

The liquid transparentizing material can be applied to one or both sides of a substrate. It is preferred, however, that it be applied simultaneously to both sides of an area of the substrate. Such simultaneous application provides even faster penetration of the liquid into the substrate.

Advantageously, the use of one or more of the above-recited monomers, without oligomers or prepolymers, results in a coating which not only penetrates a substrate very quickly, but also produces a transparentized portion that meets all of the desired physical and chemical properties. Physically, the transparentized portion is strong, flexible, and durable, such that it will maintain its transparency when subjected to rough handling. In addition, transparentized portion is highly receptive to inks.

Chemically, the transparentized portion has sufficient resistance to ultraviolet radiation that it does not yellow and/or lose its transparency over time. It is believed that such resistance to ultraviolet radiation is a result of the aliphatic, as opposed to aromatic, structure of the above-recited monomers. Due to the rapid penetration of the coating into substrate, the coating can be cured almost immediately after it has been applied. Moreover, when the coating is 100% solids, it is less mobile and less volatile after curing than one containing a solvent, thus further reducing the tendency to migrate or volatilize.

When the coating is comprised of one or more of the above-recited monomers, without oligomers or prepolymers, the refractive index of the cured coating ranges from about 1.48 to about 1.5. Under most circumstances, this matches closely enough with that of the cellulosic substrate that the transparentized portion will be sufficiently transparent.

However, some cellulosic substrates have a refractive index which is greater than 1.5. With such substrates, it may be desirable to include one or more prepolymers with the coating in order to increase the refractive index of the cured coating to substantially match that of the substrate. Typically, 1.55 is the highest value that the refractive index of the cured coating will need to attain in this manner. The preferred prepolymers for this function include styrene-maleic anhydride, styrene-acrylic acid, and styrene-methacrylic acid. The most preferred prepolymer of this group is styrene-maleic anhydride.

It may also be desirable in certain situations to have a transparentized portion with extra flexibility. For this purpose, an oligomer may be included with the coating. The preferred oligomers in this instance are urethane acrylate oligomer and styrene-acrylic oligomer.

Further, an amine may be included with the coating in order to reduce the curing time thereof. The preferred amine for this purpose is triethanol amine.

In order that the invention may be more readily understood, reference is made to the following examples, which are intended to be illustrative of the present embodiment of the invention, but are not intended to be limiting in scope.

EXAMPLE 1

A radiation curable liquid transparentizing material was prepared in accordance with this embodiment of the present invention by blending the materials listed below. The liquid was then applied to a substrate by flexographic printing and cured by ultraviolet radiation at a wavelength of from about 200 to about 400 nanometers.

| | Percent by Weight |
|---|---|
| Styrene-maleic anhydride[1] | 7.24 |
| 1,6 Hexanedioldiacrylate[2] | 30.72 |
| Trimethylolpropane triacrylate[3] | 34.48 |
| Monohydroxy pentacrylate[4] | 4.82 |
| Urethane acrylate[5] | 10.34 |
| Photocatalyst[6] | 12.40 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 2

A radiation curable transparentizing liquid was prepared as in Example 1 using the following materials:

| | Percent by Weight |
|---|---|
| Styrene-maleic anhydride[1] | 6.67 |
| 1,6 Hexanedioldiacrylate[2] | 62.60 |
| Trimethylolpropane triacrylate[3] | 20.89 |
| Photocatalyst[4] | 9.84 |

[1]SMA 1000A from Arco Chemical
[2]SR-238 from Sartomer
[3]SR-351 from Sartomer
[4]Iracure 500 from Ciba Geigy

EXAMPLE 3

A radiation curable transparentizing liquid was prepared as in Example 1 using the following materials:

| | Percent by Weight |
|---|---|
| 1,6 Hexanedioldiacrylate[1] | 78.86 |
| Urethane acrylate[2] | 8.10 |
| Photocatalyst[3] | 13.04 |

[1]SR-238 from Sartomer
[2]CN-962 from Sartomer
[3]Iracure 500 from Ciba Geigy

EXAMPLE 4

A radiation curable transparentizing liquid was prepared as in Example 1 using the following materials:

| | Percent by Weight |
|---|---|
| Styrene-maleic anhydride[1] | 6.58 |
| 1,6 hexanedioldiacrylate[2] | 27.90 |
| Trimethylolpropane triacrylate[3] | 31.34 |
| Monohydroxy Pentacrylate[4] | 4.38 |
| Urethane acrylate[5] | 9.40 |
| Hexyl carbitol | 9.20 |
| Photocatalyst[6] | 11.20 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 5

A radiation curable transparentizing liquid was prepared as in Example 1 using the following materials:

| | Percent by Weight |
|---|---|
| 1,6 Hexanedioldiacrylate[1] | 33.52 |
| Trimethylolpropane triacrylate[2] | 47.86 |
| Monohydroxy Pentacrylate[3] | 7.01 |
| Urethane acrylate[4] | 3.19 |
| Triethanol amine | 2.55 |
| Photocatalyst[5] | 5.87 |

[1]SR-238 from Sartomer
[2]SR-351 from Sartomer
[3]SR-9041 from Sartomer
[4]CN-962 from Sartomer
[5]Iracure 500 from Ciba Geigy

EXAMPLE 6

A radiation curable transparentizing liquid was prepared as in Example 1 using the following materials:

| | Percent by Weight |
|---|---|
| Hexanedioldiacrylate[1] | 27.61 |
| Trimethylolpropane triacrylate[2] | 39.37 |
| Monohydroxy pentacrylate[3] | 5.51 |
| Vinyl pyrrolidone | 15.70 |
| Photocatalyst[4] | 11.81 |

[1]SR-238 from Sartomer
[2]SR-351 from Sartomer
[3]3R-9041 from Sartomer
[4]Iracure 500 from Ciba Geigy

EXAMPLE 7

A radiation curable transparentizing liquid was prepared as in Example 1 using the following materials:

| | Percent by Weight |
|---|---|
| Hexanedioldiacrylate[1] | 28.22 |
| Trimethylolpropane triacrylate[2] | 40.35 |
| Monohydroxy pentacrylate[3] | 5.64 |
| Tripropylene glycol diacrylate[4] | 16.12 |
| Photocatalyst[5] | 9.67 |

[1]SR-238 from Sartomer
[2]SR-351 from Sartomer
[3]SR-9041 from Sartomer
[4]Photomer 4061 from Henkel
[5]Iracure 500 from Ciba Geigy

Security Document According to Another Embodiment of the Present Invention

Figure 16:
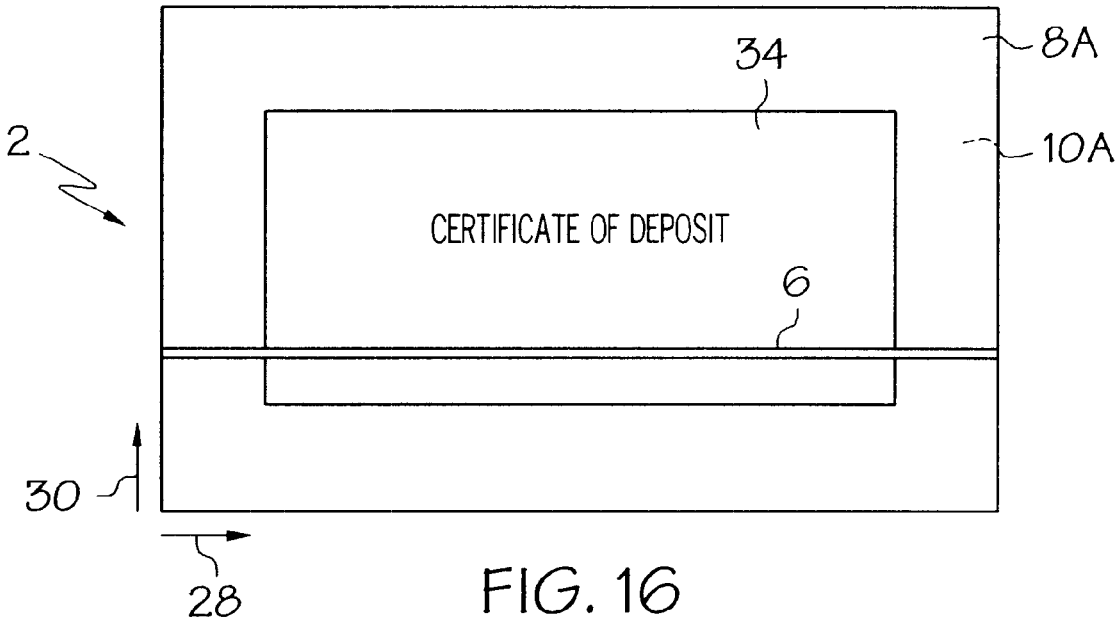
FIG. 16 is an enlarged, plan view, of a security document according to yet another aspect of the present invention.

FIG. 16 illustrates a security document 2 according to yet another embodiment of the present invention. The security document 2 includes a first major surface 8A which corresponds to the first major surface 8 of the substrate 4, and a second major surface 10A which corresponds to the second major surface 10 of the substrate 4.

The security document 2 can be any document of value and may carry printed indicia 34 on one or both surfaces 8A, 10A of the security document 2. As is shown in the illustrated embodiment, the security document 2 carries printed indicia 34 on the first major surface 8A. The printed indicia 34, such as the printed matter for a bank note, may be applied to the first major surface 8 of the substrate 4 through any printing technique commonly used in the art.

The simulated security thread 6 may be added to the substrate 4 before printed indicia 34 is applied to the substrate 4 for optimum security and protection. It should be apparent that simulated security thread 6 may be added to the substrate 4 during or after the printed indicia 34 is applied to the substrate 4. In addition, the security document 2, may be comprised of substrate 4 which has previously been manufactured in a conventional manner, thereby significantly reducing the manufacturing costs of the security document 2.

Having described the invention in detail and by reference to preferred embodiments thereof, it will be apparent that modifications and variations are possible without departing from the scope of the invention defined in the appended claims.

What is claimed is:

1. A security document, comprising:

a finished cellulosic substrate having at least one transparentized portion formed therein, wherein said substrate defines first and second major surfaces;

said transparentized portion comprising a transparentizing composition applied to at least one of said first and second major surfaces so as to define an area of increased transparency in said substrate;

said area of increased transparency including at least one thin line; and said area of increased transparency resembling a simulated security thread.

2. The security document of claim 1, wherein said substrate further comprises printed indicia on at least one of said first and second major surfaces.

3. The security document of claim 1, wherein said substrate comprises material selected from the group consisting of wood pulp fibers, vegetable fibers, plant fibers, plastics, synthetics, and polymeric films, and combinations thereof.

4. The security document of claim 1, wherein said substrate is comprised of a web of material.

5. The security document of claim 1, wherein said substrate is comprised of an individual cut sheet.

6. The security document of claim 1, wherein said transparentizing composition is applied to at least one of said first and second major surfaces to define a plurality of thin lines.

7. The security document of claim 1, wherein the width of said simulated security thread is between about 0.015 and about 0.0625 inches.

8. The security document of claim 1, wherein said substrate defines an area of reduced thickness.

9. The security document of claim 8, wherein said area of reduced thickness lies on said first major surface.

10. The security document of claim 8, wherein said area of reduced thickness lies on both said first major surface and said second major surface.

11. The security document of claim 8, wherein said area of reduced thickness is between about 0.0005 and about 0.002 inches thick.

12. The security document of claim 8, wherein said area of reduced thickness defines said transparentized portion.

13. The security document of claim 12, wherein said transparentized portion defines said simulated security thread.

14. The security document of claim 12, wherein the thickness of said transparentized portion does not exceed the thickness of the remainder of said substrate.

15. The security document of claim 12, wherein said transparentized portion has a higher density than the remaining areas of said substrate.

16. The security document of claim 8, wherein said area of reduced thickness defines a groove in said substrate.

17. The security document of claim 16, wherein said groove is slightly rounded along the top and bottom portions of said groove.

18. The security document of claim 16, wherein said groove has relatively vertical side walls.

19. The security document of claim 16, wherein said transparentizing composition is applied to said groove, which defines said transparentized portion in said substrate.

20. The security document of claim 19, wherein said transparentized portion defines said simulated security thread.

21. The security document of claim 1, wherein said substrate defines a textured portion and wherein said at least one thin line is further defined by said textured portion.

22. The security document of claim 21, wherein said textured portion and said transparentized portion lie in common areas of said substrate.

23. The security document of claim 22, wherein said textured portion and said transparentized portion define substantially identical boundaries and wherein said textured portion and said transparentized portion are positioned in substantial alignment on said substrate.

24. The security document of claim 21, wherein said textured portion defines a variable thickness profile and wherein said transparentizing composition is applied across said variable thickness profile such that said area of increased transparency defines a varying transparency.

25. The security document of claim 1, wherein said transparentizing composition comprises a radiation-curable composition.

26. The security document of claim 1, wherein said transparentizing composition is selected so as to cure upon contact with said substrate.

27. The security document of claim 1, wherein said transparentizing composition further comprises a security agent.

28. The security document of claim 27, wherein said security agent is a photochromic agent, a thermochromic agent, a fluorescent agent, a coloring agent, a fragrance, a UV ink, an optically variable ink, or a combination thereof.

29. The security document of claim 1, wherein said transparentized portion further comprises a printed portion, which comprises printed matter.

30. The security document of claim 29, wherein said printed matter is completely covered by said transparentizing composition.

31. The security document of claim 29, wherein said printed matter is partially covered by said transparentizing composition.

32. The security document of claim 29, wherein said printed matter comprises a line of text written in white ink, thermochromic ink, photochromic ink, or combinations thereof.

33. The security document of claim 29, wherein said printed matter lies in said area of reduced thickness of said substrate.

34. The security document of claim 29, wherein said printed matter comprises an amount field of a negotiable document.

35. The security document of claim 29, wherein said printed matter comprises a secure data field.

36. The security document of claim 1, wherein said at least one thin line comprises a first simulated security thread and a second simulated security thread.

37. The security document of claim 36, wherein said first and second simulated security threads are formed on the same said major surface of said substrate.

38. The security document of claim 36, wherein said first and second simulated security threads are formed on said first and second major surfaces, respectively, of said substrate.

39. The security document of claim 36, wherein said first simulated security thread is a first color and wherein said second simulated security thread is a second color.

40. The security document of claim 39, wherein said first color is different than said second color.

41. The security document of claim 36, wherein said first simulated security thread overlaps with said second simulated security thread.

42. The security document of claim 1, wherein said simulated security thread is linear.

43. The security document of claim 1, wherein said simulated security thread is curvilinear.

44. The security document of claim 43, wherein said curvilinear simulated security thread is asymmetrical.

45. The security document of claim 1, wherein said simulated security thread has a varying width.

46. The security document of claim 1, wherein said simulated security thread is discontinuous.

47. The security document of claim 46, wherein said discontinuous simulated security thread comprises a plurality of individual discrete simulated security threads.

48. The security document of claim 1, wherein said at least one simulated security thread extends in a direction which is parallel to a machine direction of said substrate.

49. The security document of claim 1, wherein said at least one simulated security thread extends in a direction which is parallel to a cross-web direction of said substrate.

50. The security document of claim 1, wherein said at least one simulated security thread extends in a direction which is diagonal between a machine direction and a cross-web direction of said substrate.

51. A security document comprising a finished cellulosic substrate having at least one transparentized portion formed therein, wherein said substrate defines first and second major surfaces, said transparentized portion comprises a transparentizing composition applied to at least one of said first and second major surfaces to define an area of increased transparency in said substrate resembling a simulated security thread, and wherein said transparentizing composition comprises at least one compound selected from compounds of the formula:

(I)

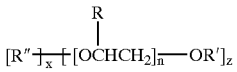

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different; or (II)

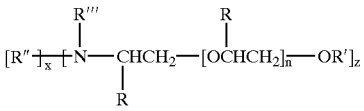

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R'" is H or a group of the formula:

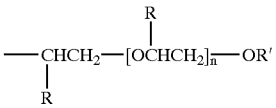

wherein R, R', and n are as defined as above, wherein if any of R, R', R" or R'" are greater than one, their identities and the number of each may be the same or different.

52. A security document comprising a finished cellulosic substrate having at least one transparentized portion formed therein, wherein said substrate defines first and second major surfaces, said transparentized portion comprises a transparentizing composition applied to at least one of said first and second major surfaces to define an area of increased transparency in said substrate resembling a simulated security thread, and wherein said transparentizing composition comprises:

i) a cationic catalyzable constituent selected from 1) a vinyl ether, 2) a polyepoxide, 3) a mixture of vinyl ethers, 4) a mixture of polyepoxides, or 5) a mixture of at least one of a vinyl ether and at least one of a polyepoxide;

ii) a free radical catalyzable constituent selected from at least one compound of the Formula:

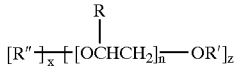

wherein,

R" is any mono- or polyfunctional organic radical;

R is H or $CH_3$;

R' is H or —C(O)C(R)═$CH_2$ with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different; and iii) a catalyst constituent selected from 1) a free radical catalyst, 2) a mixture of free radical catalysts, 3) a living cationic catalyst, 4) a mixture of living cationic, catalysts, or 5) mixtures of at least one of a free radical catalyst and at least one of a living cationic catalyst.

53. A security document comprising a finished cellulosic substrate having at least one transparentized portion formed therein, wherein said substrate defines first and second major surfaces, said transparentized portion comprises a transparentizing composition applied to at least one of said first and second major surfaces to define an area of increased transparency in said substrate resembling a simulated security thread, and wherein said transparentizing composition comprises at least one monomer selected from the group consisting of acrylic esters of polyhydric alcohols, methacrylic esters of polyhydric alcohols, and vinyl ethers.

54. A security document comprising a finished cellulosic substrate having at least one transparentized portion formed therein, wherein said substrate defines first and second major surfaces, said transparentized portion comprises a transparentizing composition applied to at least one of said first and second major surfaces to define an area of increased transparency in said substrate resembling a simulated security thread, and wherein said transparentizing composition comprises a polymer consisting of aliphatic monomers selected from the group consisting of acrylic esters of polyhydric alcohols, methacrylic esters of polyhydric alcohols, and vinyl ethers.

* * * * *

UNITED STATES PATENT AND TRADEMARK OFFICE

CERTIFICATE OF CORRECTION

PATENT NO. : 6,607,813 B2
APPLICATION NO. : 09/935933
DATED : August 19, 2003
INVENTOR(S) : Washburn et al.

It is certified that error appears in the above-identified patent and that said Letters Patent is hereby corrected as shown below:

Col. 45, line 52, "Hexanedioldiacrylate[1]" should be --1,6 Hexanedioldiacrylate[1]--
Col. 45, line 60, "3R-9041 from Sartomer" should be --SR-9041 from Sartomer--
Col. 46, line 5, "Hexanedioldiacrylate[1]" should be --1,6 Hexanedioldiacrylate[1]--
Col. 50, line 37 "4) a mixture of living cationic, catalysts, or" should be --4) a mixture of living cationic catalysts, or--

Col. 17, beneath the compound formed as a result of step d

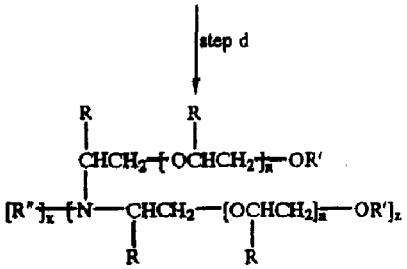

"6" should be --II--

Signed and Sealed this

Eighth Day of August, 2006

JON W. DUDAS
*Director of the United States Patent and Trademark Office*